US008297745B2

(12) United States Patent
Lee et al.

(10) Patent No.: US 8,297,745 B2
(45) Date of Patent: Oct. 30, 2012

(54) IMAGE FORMING APPARATUS

(75) Inventors: Young Su Lee, Suwon-si (KR); Jin Ho Park, Yongin-si (KR); Myung Song Jung, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 916 days.

(21) Appl. No.: 12/323,812

(22) Filed: Nov. 26, 2008

(65) Prior Publication Data

US 2009/0141093 A1 Jun. 4, 2009

(30) Foreign Application Priority Data

Nov. 30, 2007 (KR) ..... 10-2007-0123550
Sep. 17, 2008 (KR) ..... 10-2008-0090983

(51) Int. Cl.
*B41J 2/175* (2006.01)

(52) U.S. Cl. ..... 347/85

(58) Field of Classification Search ..... 347/42, 347/49, 66, 84, 85
See application file for complete search history.

(56) References Cited

U.S. PATENT DOCUMENTS

| | | | | |
|---|---|---|---|---|
| 5,192,959 | A | 3/1993 | Drake et al. | |
| 5,489,925 | A * | 2/1996 | Brooks et al. | 347/6 |
| 5,980,021 | A * | 11/1999 | Nagoshi et al. | 347/49 |
| 6,145,971 | A * | 11/2000 | Baker et al. | 347/85 |
| 6,290,343 | B1 * | 9/2001 | Lewis et al. | 347/85 |
| 6,406,122 | B1 * | 6/2002 | Sharma et al. | 347/28 |
| 6,848,775 | B2 * | 2/2005 | Ishizawa et al. | 347/86 |
| 6,942,316 | B2 * | 9/2005 | Scheffelin et al. | 347/42 |
| 7,357,496 | B2 * | 4/2008 | Silverbrook et al. | 347/86 |

* cited by examiner

*Primary Examiner* — Anh T. N. Vo
(74) *Attorney, Agent, or Firm* — Stanzione & Kim, LLP

(57) ABSTRACT

An image forming apparatus including a body, a print head including a nozzle part having a length corresponding to a width of a printing medium, and a regulator provided separately from the print head and mounted to the body, the regulator serves to adjust a negative pressure of ink which is to be supplied into the print head.

26 Claims, 16 Drawing Sheets

IMAGE FORMING APPARATUS

CROSS-REFERENCE TO RELATED APPLICATIONS

This application claims priority under 35 U.S.C. §119(a) from Korean Patent Application No. 2007-0123550, filed on Nov. 30, 2007 in the Korean Intellectual Property Office, and Korean Patent Application No. 10-2008-90983, filed on Sep. 17, 2008 in the Korean Intellectual Property Office, the disclosures of which are incorporated herein in their entirety by reference.

BACKGROUND OF THE INVENTION

1. Field of the Invention

The present general inventive concept relates to an image forming apparatus, and, more particularly, to an image forming apparatus wherein a nozzle part has a length corresponding to a width of a printing medium.

2. Description of the Related Art

An image forming apparatus is an apparatus which is used to develop a black-and-white image or a color image on a printing medium, such as paper, according to a print signal. Examples of the image forming apparatus include laser printers, inkjet printers, copiers, facsimiles, and devices combining functions thereof.

Of various image forming apparatuses, an inkjet type image forming apparatus is designed to form an image by ejecting liquid-phase ink onto a surface of a printing medium according to a print signal. Such an inkjet type image forming apparatus includes a print head which is used to eject ink according to a print signal. As the print head ejects ink droplets according to a print signal, an image, such as a letter, figure, or etc., is printed on a printing medium.

The inkjet type image forming apparatus is classified into a shuttle type image forming apparatus and an array type image forming apparatus. In the shuttle type image forming apparatus, a print head ejects ink while reciprocating in a direction orthogonal to a delivery direction of the printing medium, namely, in a width direction of the printing medium. In the array type image forming apparatus, a length of a print head corresponds to a width of a printing medium to allow for line printing.

The print head of the array type image forming apparatus is provided with a plurality of head chips which are arranged in a width direction of a printing medium to allow for line printing, a regulator to apply a negative pressure to the ink being delivered to the head chips, and an ink tank to store the ink which is to be ejected from the head chips, and the like.

The above-described print head of the array type image forming apparatus becomes superannuated during use and therefore, is detachably mounted in a body to allow for an exchange thereof. However, due to the fact that the regulator is installed in the print head, the conventional image forming apparatus has a problem in that even a normally operating regulator must also be exchanged with an exchange of the print head.

Further, the ink tank is installed in the print head and therefore, has a limit in size below a predetermined level so that the ink tank may be installed in the print head.

Furthermore, when it is necessary to separate the print head from the body, power and signal cables, which extend from the body, must first be separated from the print head prior in order to separate the print head, and then, the power and signal cables must be reconnected to a new print head after the new print head is installed into the body. Therefore, an exchange of the print head requires additional troublesome fitting and separating operations.

SUMMARY OF THE INVENTION

Accordingly, the present general inventive concept provides an image forming apparatus wherein a regulator may be continuously used without replacement or exchange.

The present general inventive concept also provides an image forming apparatus capable of using an ink tank with a sufficiently large size.

The present general inventive concept also provides an image forming apparatus wherein a print head is easy to replace or exchange.

Additional aspects and/or utilities of the present general inventive concept will be set forth in part in the description which follows and, in part, will be obvious from the description, or may be learned by practice of the present general inventive concept.

The foregoing and/or other aspects and utilities of the general inventive concept may be achieved by providing an image forming apparatus which includes a body, a print head including a nozzle part having a length equal to or greater than a width of a print medium, and a regulator provided apart from the print head and mounted onto the body, the regulator to adjust a negative pressure of ink which is to be supplied into the print head.

The image forming apparatus may further include an ink tank mounted onto the body to store the ink which is to be supplied to the print head.

The image forming apparatus may further include an ink pump mounted onto the body to withdraw the ink from the print head.

The image forming apparatus may further include a head mount provided at the body to mount the print head, at least one first connector provided at the head mount, and at least one second connector provided at the print head to correspond to the at least one first connector.

The first connector and second connector may be connected to each other when the print head is mounted to the head mount.

The first connector may include at least one of a first power connector to supply power to the print head, a first signal connector to transmit signals to the print head, a first supply connector which is connected with an ink supply tube to supply the ink, and a first discharge connector connected with an ink discharge tube for discharge of the ink of the print head.

The second connector may include at least one of a second power connector connected with the first power connector to receive or transmit power therebetween, a second signal connector connected with the first signal connector to receive or transmit signals therebetween, a second supply connector connected with the first supply connector to supply ink into the nozzle part, and a second discharge connector connected with the first discharge connector to receive ink transmitted thereto.

The first supply connector may include a first connector body having a first chamber and a first sealing member installed in the first connector body and having a first orifice connected with the first chamber, the second supply connector may include a second connector body having a second chamber and a second sealing member installed in the second connector body and having a second orifice connected with the second chamber, and a flow-path connecting device may be installed between the first connector body and the second connector body and may include a flow-path tube having a first end inserted into the first orifice to thereby be connected with the first chamber and a second end inserted into the second orifice to thereby be connected with the second chamber.

A first valve member to open or close the first orifice and a first valve spring to press the first valve member so as to cause the first valve member to come into contact with the first sealing member may be installed in the first chamber, and a second valve member to open or close the second orifice and a second valve spring to press the second valve member so as to cause the second valve member to come into contact with the second sealing member may be installed in the second chamber.

The second discharge connector may include a third connector body having a third chamber and a third sealing member installed in the third connector body and having a third orifice connected with the third chamber, and the first discharge connector may include an insertion tube to be inserted into the third orifice to thereby be connected with the third chamber.

A third valve member to open or close the third orifice and a third valve spring to press the third valve member so as to cause the third valve member to come into contact with the third sealing member may be installed in the third chamber.

The foregoing and/or other aspects and utilities of the general inventive concept may also be achieved by providing an image forming apparatus which includes a body, a print head including a nozzle part having a length equal to or greater than a width of a print medium, a cradle pivotally and/or rotatably mounted in the body, an ink tank provided apart from the print head and mounted in the body, in which ink is stored, and a regulator provided apart from the print head and mounted in the body, the regulator to adjust a negative pressure of the ink which is to be supplied from the ink tank to the print head.

The foregoing and/or other aspects and utilities of the general inventive concept may also be achieved by providing a printhead usable with an image forming apparatus having an ink tank and/or a regulator, the printhead includes at least one ink supply connector which includes at least one valve member, the at least one valve member being movable between a first position and a second position, the first position prevents ink communication between the printhead and the ink tank via the at least one ink supply connector and the second position allows ink communication between the printhead and the ink tank via the at least one ink supply connector, such that an insertion of the printhead onto the image forming apparatus provides ink communication between the printhead and the image forming apparatus.

The insertion of the printhead onto the image forming apparatus may move the at least one valve member from the first position to the second position.

The printhead may further include a flow-path connecting device slidably attached to the at least one ink supply connector, the flow-path connecting device includes a plurality of connecting tubes which correspond to the at least one valve member, wherein the insertion of the printhead onto the image forming apparatus moves the at least one valve member from the first position to the second position by using at least one connecting tube of the plurality of connecting tubes.

The printhead may further include at least one electrical connector disposed on a same side as the at least one ink supply connector, wherein the insertion of the printhead onto the image forming apparatus simultaneously provides ink and electrical communication between the printhead and the image forming apparatus.

The at least one ink supply connector may include an ink supply connector and an ink discharge connector, and the at least one electrical connector may include a signal connector and a power connector, wherein the insertion of the printhead onto the image forming apparatus simultaneously provides ink and electrical communication between the printhead and the image forming apparatus via the ink supply connector, the ink discharge connector, the signal connector, and the power connector, respectively.

The printhead may further include guide rails corresponding to guide grooves of the image forming apparatus, wherein the insertion of the printhead onto the image forming apparatus includes aligning the guide rails of the printhead with the guide grooves of the image forming apparatus.

The foregoing and/or other aspects and utilities of the general inventive concept may also be achieved by providing a method of manufacturing an image forming apparatus, the method includes disposing a body having a receiving unit coupled with the body, a receiving space, and a first connector installed in the receiving space, and disposing a print head detachably installed in the receiving space and including a head chip to eject ink and a second connector corresponding to the first connector, wherein the first connector and the second connector are connected to each other as the print head is inserted into the receiving space.

BRIEF DESCRIPTION OF THE DRAWINGS

These and/or other aspects and utilities of exemplary embodiments of the present general inventive concept will become apparent and more readily appreciated from the following description of the exemplary embodiments, taken in conjunction with the accompanying drawings, of which.

DETAILED DESCRIPTION OF THE PREFERRED EMBODIMENTS

Figure 1:
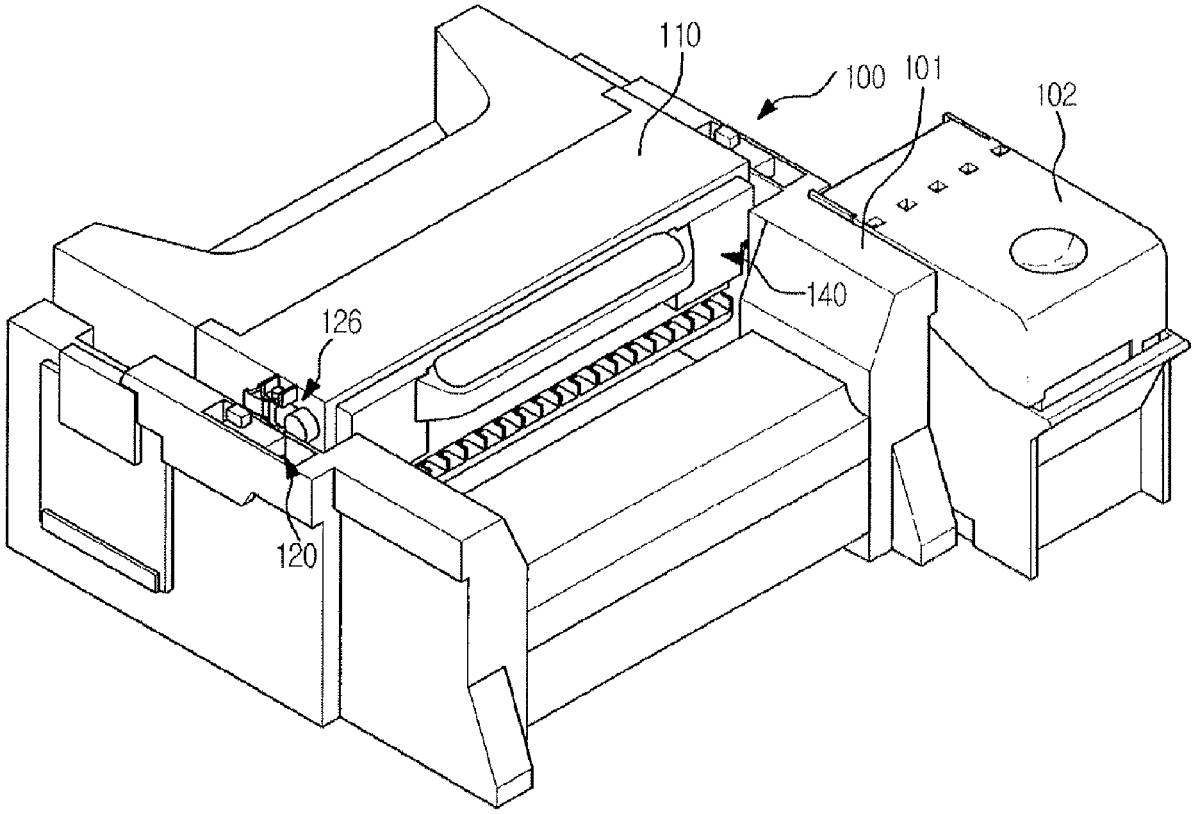
FIG. 1 is a perspective view schematically illustrating an image forming apparatus in accordance with an exemplary embodiment of the present general inventive concept.

Reference will now be made in detail to an exemplary embodiment of the present general inventive concept, examples of which are illustrated in the accompanying drawings, wherein like reference numerals refer to like elements throughout. Elements or features described as being provided "on" another element or feature are not limited thereto, and may also include being provided "at" the other element or feature. The exemplary embodiments are described below to explain the present general inventive concept by referring to the figures.

Hereinafter, an image forming apparatus in accordance with an exemplary embodiment of the present general inventive concept will be described with reference to the accompanying drawings.

Figure 6:
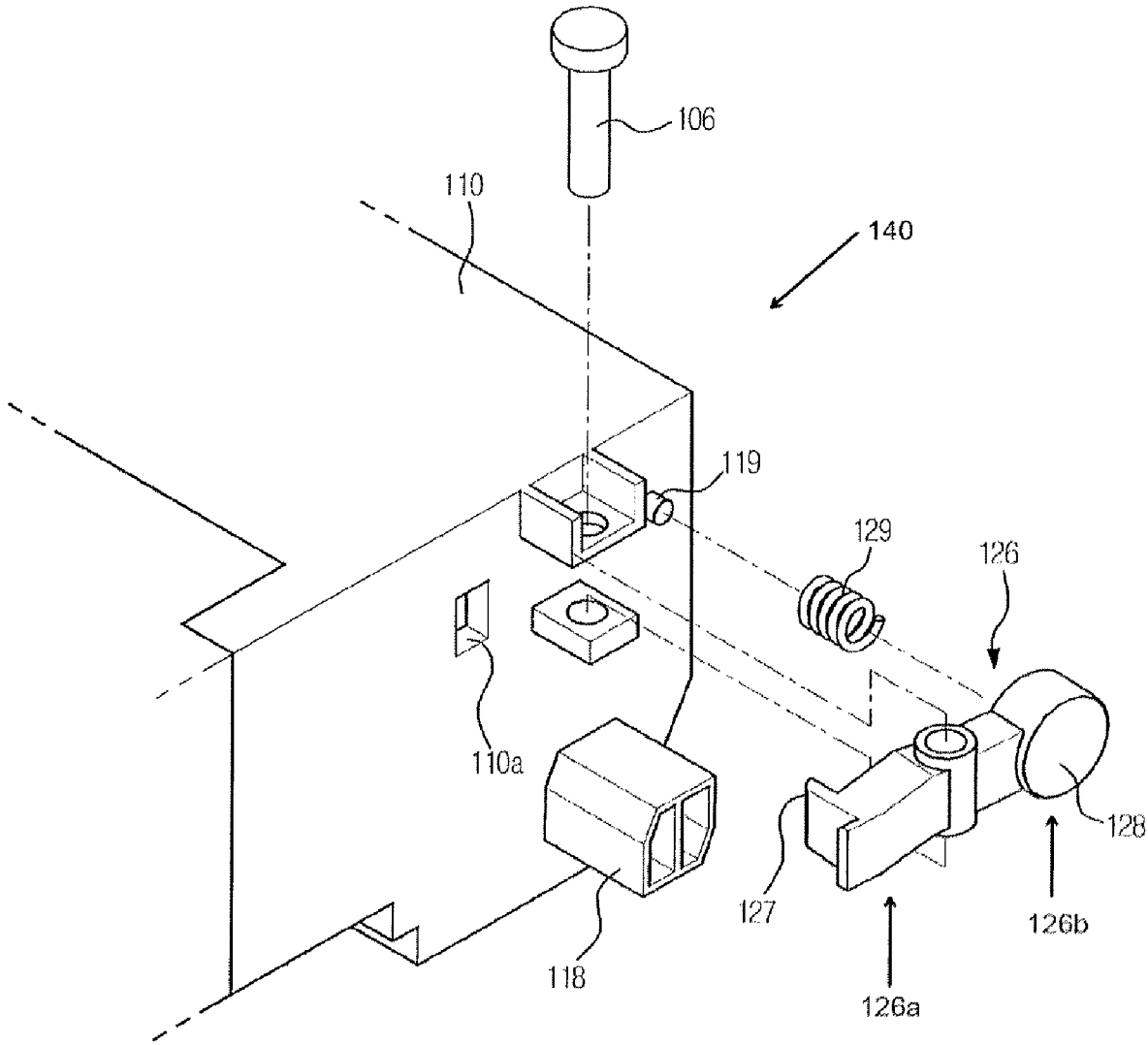
FIG. 6 is an exploded perspective view illustrating a detachable lever of the image forming apparatus in accordance with the exemplary embodiment of FIG. 1.

As illustrated in FIG. 1, the image forming apparatus 100 in accordance with an exemplary embodiment of the present general inventive concept includes a body 101, and a print head 140 provided separately from the body 101 and detachably mounted onto the body 101 to allow a replacement thereof, as necessary. A head mount 114 (see FIG. 2), onto which the print head 140 is mounted, is located in an upper region of the body 101. In an exemplary embodiment, the print head 140, as illustrated in FIG. 6, may be an array type print head 140, in which nozzles 146*a* (see FIG. 7) have a total length which is at least greater than a width of a printable printing medium, such as paper. In alternative exemplary embodiments, the array type print head 140 may be a single print head 140 which may have a length substantially corresponding to a width of a printing medium, or may be a plurality of print heads 140 having a total length substantially corresponding to a width of a printing medium. In the present exemplary embodiment, the print head 140 includes a plurality of head chips 146, each having the nozzle 146*a*, such that all the nozzles 146*a* have a length substantially corresponding to a width of a printing medium.

Figure 2:
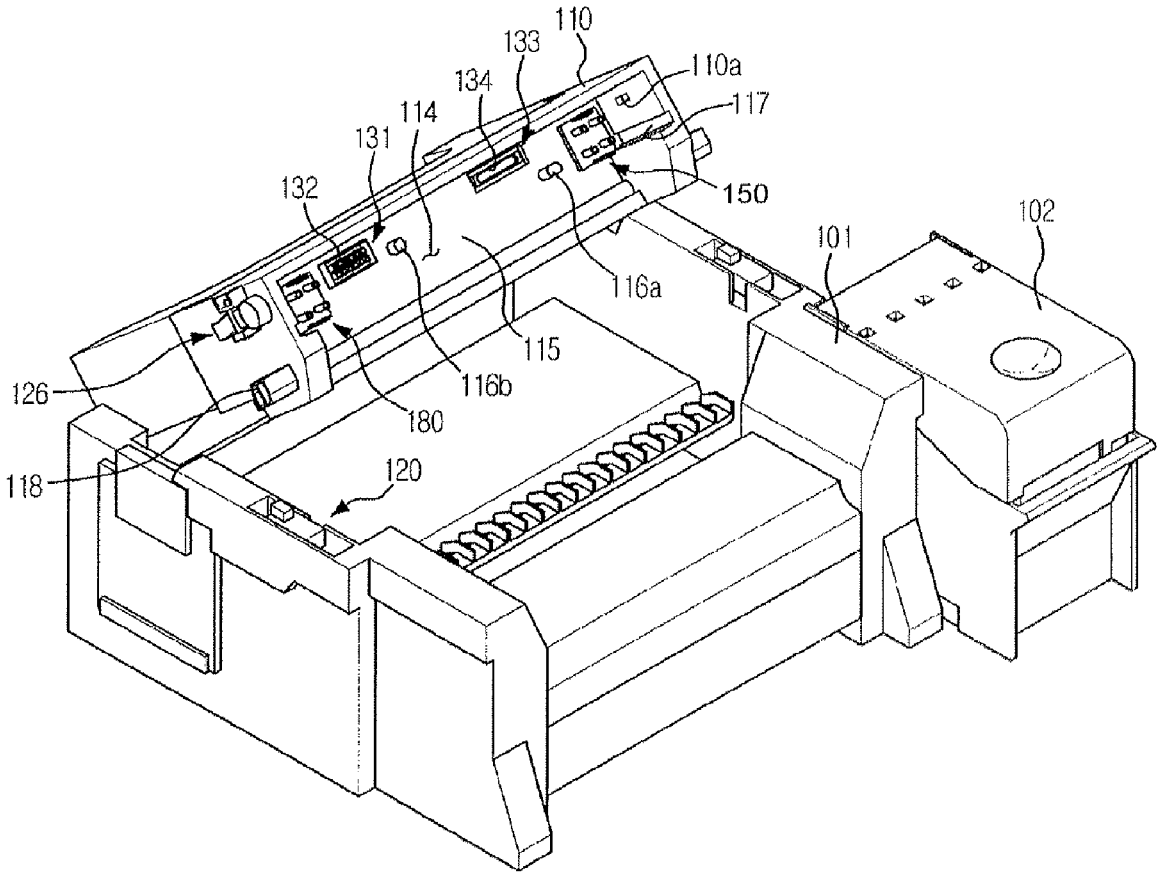
FIG. 2 is a perspective view of the image forming apparatus in accordance with the exemplary embodiment of FIG. 1, illustrating a state wherein a print head is separated from a cradle.

As illustrated in FIG. 2, a cradle 110 which allows the print head 140 to be easily mounted onto the body 101 is pivotally and/or rotatably mounted in the upper region of the body 101. In exemplary embodiments, the above-described head mount 114 is provided in the cradle 110.

The body 101 incorporates a variety of rollers (not illustrated) in order to deliver a printing medium, such as paper, a motor (not illustrated) to operate the rollers, a power source (not illustrated) to supply power, a maintenance device (not illustrated) to manage the ink ejecting nozzles 146*a* of the print head 140 in order to assure an efficient ejection of ink through the nozzles 146*a*, and a controller (not illustrated) to control general operations of the image forming apparatus 100, and the like. However, since the above-mentioned components are conventionally provided in the image forming apparatus 100, a detailed description thereof will be omitted.

Figure 3:
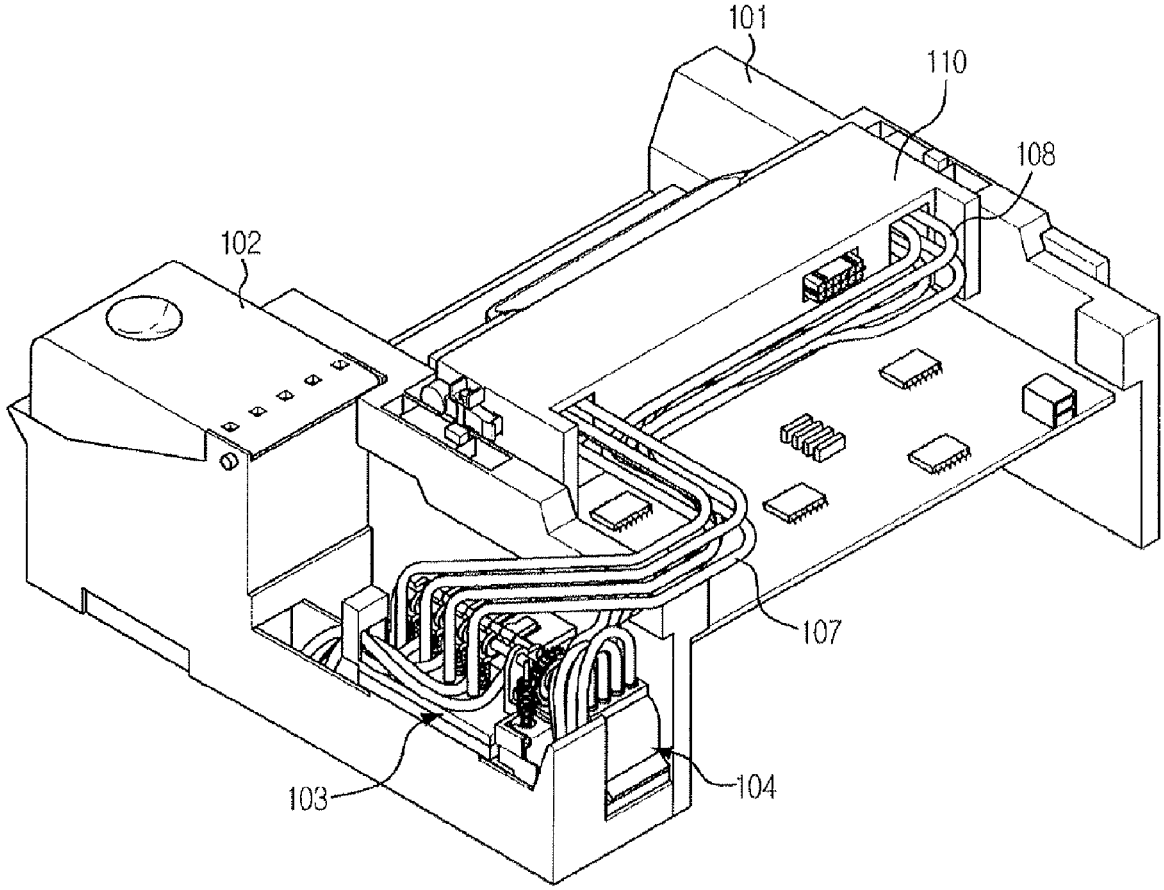
FIG. 3 is a perspective view illustrating an ink tank and a regulator installed in the image forming apparatus in accordance with the exemplary embodiment of FIG. 1.

As illustrated in FIGS. 1 and 3, the body 101 further incorporates an ink tank 102 which is used to separately store different colors of ink (for example, black, magenta, cyan, and yellow ink), a regulator 103 disposed between the ink tank 102 and the print head 140 and which serves to apply a negative pressure to the ink so as to supply an appropriate amount of the ink into the print head 140, only when the print head 140 ejects ink, and an ink pump 104 to circulate ink so as to collect ink that may coagulate in the print head 140 or which may contain air, the ink tank 102, regulator 103, and ink pump 104 being arranged in parallel with each other. That is, in exemplary embodiments, the regulator 103 is in parallel fluid communication with the ink tank 102, the print head 140, and the ink pump 104 or air, such that the regulator 103 may provide a pressure, such as a negative pressure, to the ink which is disposed within the ink tank 102 to thereby supply the appropriate amount of ink to the print head 140, only when the print head 140 ejects ink. In exemplary embodiments, the ink pump 104 or an external air supply (not illustrated) may be used to circulate ink between the ink tank 102 and the print head 140 in order to aid in the maintenance of the image forming apparatus 100. For example, the ink pump 104 or an external air supply (not illustrated) may be used to remove coagulated ink or ink having air therein from the print head 104.

In the present exemplary embodiment, the ink tank 102 is provided separately from the print head 140 and is mounted onto the body 101. If the ink tank 102 was mounted in the print head 140, the ink tank 102 would inevitably be limited to a size below a predetermined level which would be allowed by the print head 140. However, when the ink tank 102 is mounted onto the body 101, as described in the present exemplary embodiment, the ink tank 102 is less limited in size and may therefore have a larger size according to desired design requirements. As a result, the ink tank 102, according to an exemplary embodiment of the present general inventive concept, has the effect of increasing an exchange period of the ink tank 102. That is, a larger ink tank 102 would be able to provide ink to the print head 140 for a longer period of time, thereby reducing an amount of maintenance required for the image forming apparatus 100.

Also, in the present exemplary embodiment, similar to the ink tank 102, the regulator 103 may be provided separately from the print head 140 and may be mounted onto the body 101. If the regulator 103 was mounted in the print head 140, an unnecessary exchange of the regulator 103 would be inevitable, since an exchange of the print head 140 is required more frequently than an exchange of the regulator 103. That is, if the regulator 103 is mounted in the print head 140, the regulator 103 would be unnecessarily exchanged with the exchange of the print head 140. However, when the regulator 103 is provided separately from the print head 140 and is mounted onto the body 101, as described in the present exemplary embodiment, the regulator 103 may remain onto the body 101 even upon the exchange of the print head 140. Thus, as a result of the present general inventive concept, a reduction in maintenance costs of the image forming apparatus 100 may be achieved.

Figure 4:
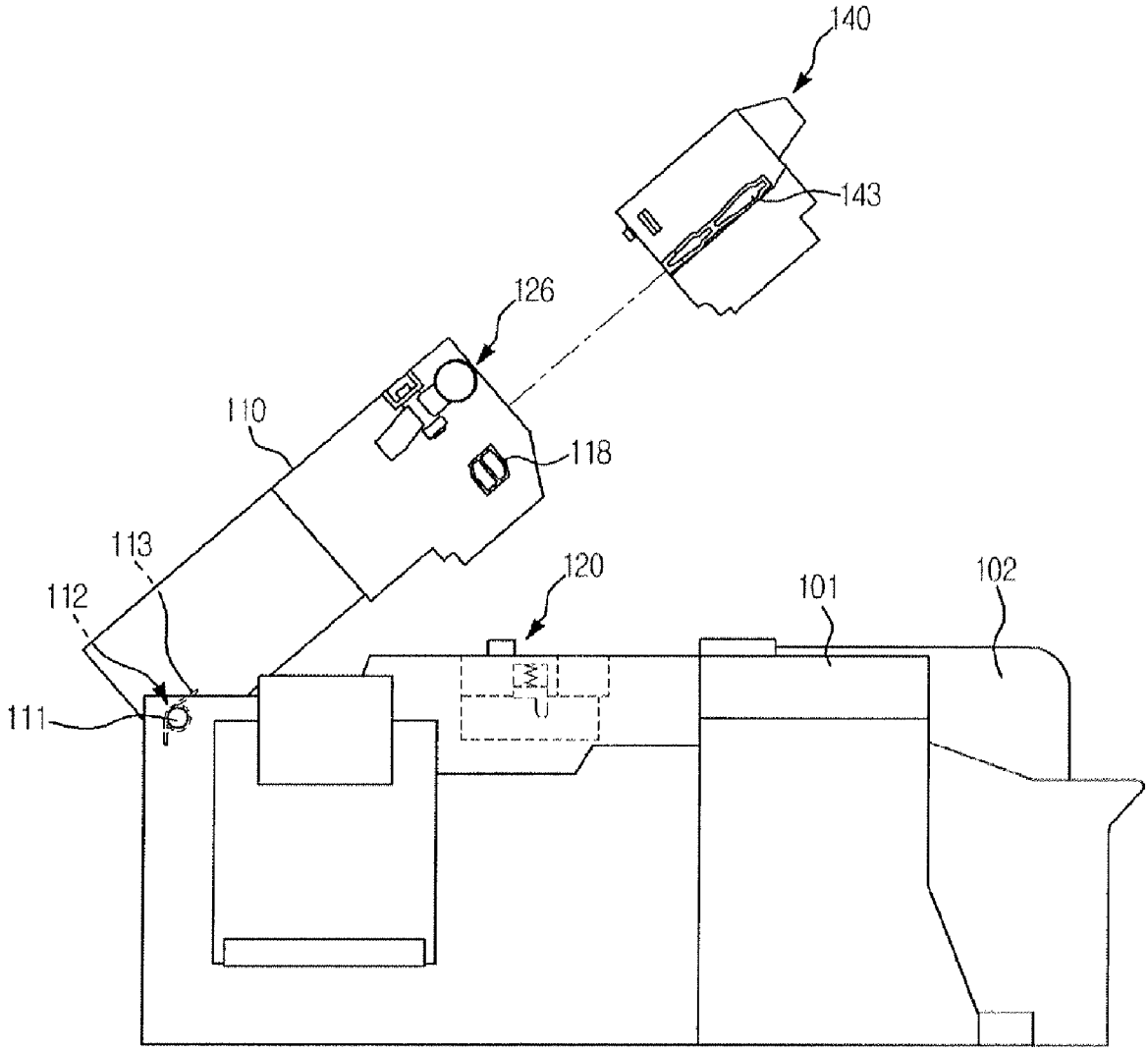
FIG. 4 is a schematic side view of the image forming apparatus in accordance with the exemplary embodiment of FIG. 1.

As illustrated in FIG. 4, the cradle 110 may be installed in the upper region of the body 101 such that it may be pivotally rotatable by a predetermined angle. In exemplary embodiments, rear ends 110*b* of opposite side surfaces of the cradle 110 may be supported by hinge shafts 111 at the body 101. In further exemplary embodiments, the hinge shafts 111 may be provided at the body 101, or may be provided on the cradle 110. When the hinge shafts 111 are provided at the body 101, the cradle 110 may include hinge portions (not illustrated) to couple the hinge shafts 111. In alternative exemplary embodiments, when the hinge shafts 111 are provided on the cradle 110, the body 101 may include the hinge portions to couple the hinge shafts 111.

In exemplary embodiments, the body 101 may be provided with a pivoting device 112 in order to pivotally rotate the cradle 110. The pivoting device 112 may include a pair of supporting springs 113 which are installed around the respective hinge shafts 111. In an exemplary embodiment, each of the supporting springs 113 has a first end 113*a* coupled to the body 101 and a second end 113*b* coupled to the cradle 110. Each supporting spring 113 applies an elastic force to the cradle 110 sufficient to cause a front end 110*a* of the cradle 110 to be lifted. In an exemplary embodiment, the elastic force of each supporting spring 113 has strength sufficient to pivotally rotate the cradle 110 to an open position, wherein a top 101*a* of the body 101 is exposed to an external environment.

In the present exemplary embodiment, the open position of the cradle 110, as illustrated in FIGS. 2 and 4, may be a position where the front end 110*a* of the cradle 110 is lifted to expose the top 101*a* of the body 101 to the external environment. In the present exemplary embodiment, the cradle 110 may include an angle of about 45 degrees relative to a ground surface at the open position. Thus, once the cradle 110 is pivotally rotated to the open position, a user may easily couple or separate the print head 140 into or from the head mount 114 of the cradle 110. Further, even when a printing medium may become jammed during a printing process, the user may easily remove the jammed printing medium from the body 101.

Figure 5:
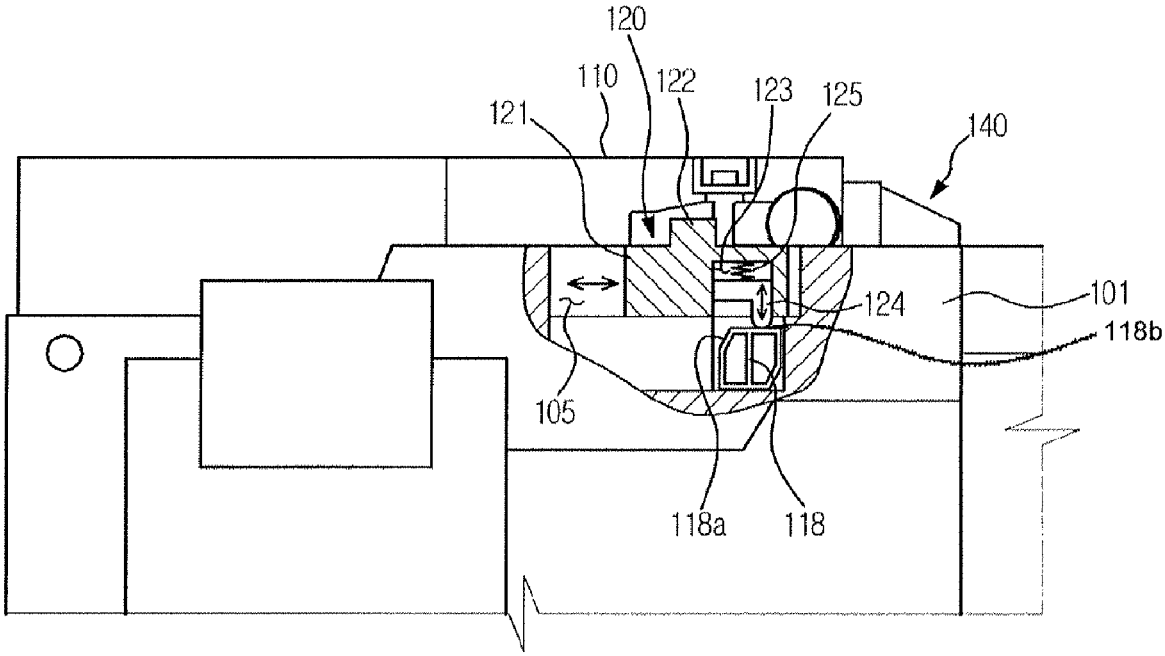
FIG. 5 is a side view of the image forming apparatus in accordance with the exemplary embodiment of FIG. 1, illustrating the cradle moved to a closed position.

In consideration of the fact that the cradle 110 may be elastically forced toward the open position by the pair of supporting springs 113, such that the front end 110*a* of the cradle 110 is lifted, the body 101 may be provided with a pair of fixing devices 120 in order to fix the cradle 110 at a closed position, wherein the cradle 110 may be substantially horizontal to the ground surface. However, the present general inventive concept is not limited thereto. That is, in exemplary embodiments, a pair of fixing devices 120 may also be provided to fix the cradle 110 at the open position. Each of the fixing devices 120, as illustrated in FIG. 5, includes a slide lever 121 which is installed in a slide recess 105 that may be defined in either side surfaces of the body 101, to thereby slidably move forward and rearward, and a stopper 124 which is vertically movably installed in a mounting recess 123 that may be defined within the slide lever 121. In exemplary embodiments, a stopper spring 125 may also be installed in the mounting recess 123 in order to apply an elastic force to the stopper 124 in a downward direction.

In exemplary embodiments, if the user pushes a grip 122 of the slide lever 121 in a forward direction, after pushing the cradle 100 toward the closed position, the stopper 124 may be brought into contact with a fixing protrusion 118 of the cradle 110. In the present exemplary embodiment, the stopper 124 may press against the fixing protrusion 118 so as to fix the cradle 110 at the closed position. In exemplary embodiments, the fixing protrusion 118 includes a slope portion 118*a*. Thus, in exemplary embodiments, if the user pushes the slide lever 121, after moving the cradle 110 to the closed position, the stopper 124 may rise along the slope portion 118*a* and may be positioned at a top portion 118*b* of the fixing protrusion 118. Then, if the user pushes the slide lever 121 in a rearward direction in a state wherein the stopper 124 presses against the fixing protrusion 118 of the cradle 110, the stopper 124 may be separated from the fixing protrusion 118, thereby allowing the cradle 110 to be pivotally rotated to the open position by the elastic force of the supporting springs 113.

In the present exemplary embodiment, the pivoting device 112 used to pivotally rotate the cradle 110 may be selected from a variety of devices capable of pivotally rotating the cradle 110 by a predetermined angle, such as a gear device or cylinder device, except for the supporting springs 113. However, the present general inventive concept is not limited thereto.

In exemplary embodiments, the cradle 110 includes the head mount 114 which is capable of receiving the print head 140, and the head mount 114 includes an open bottom. Once the print head 140 is coupled into the head mount 114 through the open bottom of the head mount 140, a head-chip assembly 145 disposed at the bottom of the print head 140 may be exposed to the external environment through the open bottom of the head mount 114.

In the present exemplary embodiment, the print head 140 may be designed to be operated upon receiving power and signals from the body 101 and ink from the ink tank 102, and the regulator 103 may be provided separately from the print head 140.

Accordingly, as illustrated in FIG. 2, the head mount 114 may be provided with a plurality of first connectors 131, 133, 150, and 180, to transmit ink, power, and signals to the print head 140.

In exemplary embodiments, the first connectors 131, 133, 150, and 180 may include a first power connector 131 to supply power to the print head 140, a first signal connector 133 to transmit signals to the print head 140, and a first supply connector 150 and a first discharge connector 180 to cause a flow of ink between the ink tank 102 and the print head 140. In exemplary embodiments, the first supply connector 150 supplies ink toward the print head 140, and the first discharge connector 180 withdraws the ink from the print head 140.

The first supply connector 150 connects the regulator 103, which is mounted in the body 101, with the print head 140 in an ink flow manner. That is, the first supply connector 150 is connected so as to provide fluid communication between the regulator 103 and the print head 140. The first discharge connector 180 connects the ink tank 102 which is mounted in the body 101 with the print head 140 in an ink flow manner. That is, in exemplary embodiments, the first discharge connector 180 is connected within the image forming apparatus 100 so as to provide fluid communication between the ink tank 102 and the print head 140.

In exemplary embodiments, the first power connector 131, first signal connector 133, first supply connector 150, and first discharge connector 180 are arranged substantially horizontal at a rear wall 115 of the head mount 114 inside the cradle 110 so as to be exposed at the front end 110*a* of the cradle 110. A plurality of coupling protrusions 116*a* and 116*b* may protrude forward, i.e., toward the front end 110*a* of the cradle 110, from the rear wall 115. In an exemplary embodiment, the first power connector 131 includes a plurality of terminal holes 132, and the first signal connector 133 includes a single terminal hole 134. However, the present general inventive concept is not limited thereto. That is, the first power connector 131 and first signal connector 133 may include any other configuration, similar to conventional connectors, which are suitable to supply or transmit power or signals.

Detailed configurations of the first supply connector 150 and first discharge connector 180 will be described hereinafter when dealing with a second supply connector 170 and a second discharge connector 190 provided on the print head 140.

In exemplary embodiments, opposite side surfaces of the head mount 114 within the cradle 110 are provided with guide grooves 117 in order to guide the print head 140 when the print head 140 is coupled into the head mount 114. The guide grooves 117 may be formed substantially horizontal at the head mount 114 to thereby allow the print head 140 to be horizontally coupled into the head mount 114. However, the present general inventive concept is not limited thereto. That is, in exemplary embodiments, the guide grooves 117 may be formed at various orientations with respect to the head mount 114 such that the first connectors 131, 133, 150, and 180 of the cradle 110 may correspond with the second connectors 135, 137, 170, and 190 of the print head 140.

In exemplary embodiments, detaching levers 126 may be provided at opposite side surfaces of the cradle 110, in order to maintain the print head 140 coupled in the head mount 114. Each detaching lever 126, as illustrated in FIG. 6, may be hingedly coupled to the opposite side surfaces of the cradle 110 by means of a supporting shaft 106. A first end 126*a* of the detaching lever 126 may be formed with a protruding portion 127, which may be inserted into the head mount 114 through an opening 110*a* which is perforated in a corresponding side surface of the cradle 110. An opposite second end 126*b* of the detaching lever 126 may be provided with a button 128 to allow for a manual operation by the user. However, the present general inventive concept is not limited thereto. That is, in exemplary embodiments, the detaching lever 126 maybe provided with various other features or devices (not illustrated) which are capable of detaching the detaching lever 126 from the cradle 110.

In exemplary embodiments, the second end of the detaching lever 126 may be subjected to an elastic force of a detaching spring 129 which is installed onto an outer surface of the cradle 110. In further exemplary embodiments, the detaching spring 129 may be installed onto a spring fixing protrusion 119 which is provided at the cradle 110, and may be used to press the button 128 of the detaching lever 126. Accordingly, the protruding portion 127 of the detaching lever 126 may be maintained at a position inserted into the head mount 114 through the opening 110*a* of the cradle 110, and may be separated from the head mount 114, only when the user pushes the button 128 to thereby detach the detaching lever 126 from the cradle 110. Once the print head 140 is coupled into the head mount 114, the print head 140 may be caught by the protruding portions 127 of both detaching levers 126, so as not to be easily separated from the head mount 114.

Figure 7:
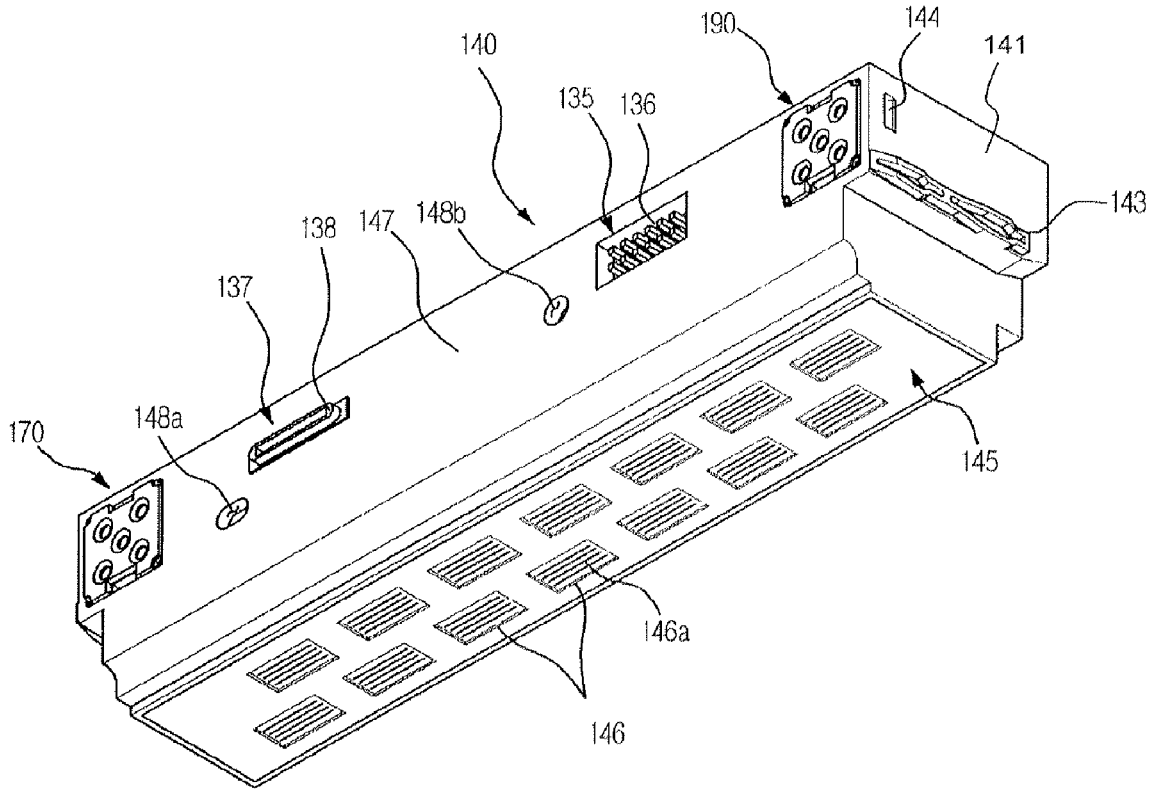
FIG. 7 is a perspective view schematically illustrating the print head of the image forming apparatus in accordance with the exemplary embodiment of FIG. 1.

The print head 140 may be detachably coupled to the cradle 110. As illustrated in FIG. 7, the print head 140 includes a head body 141, a head-chip assembly 145 provided at the bottom of the head body 141, and a plurality of second connectors 135, 137, 170 and 190 capable of being respectively connected with the plurality of first connectors 131, 133, 150 and 180 provided at the head mount 114 of the body 101.

The plurality of second connectors 135, 137, 170 and 190 which are provided at the print head 140 include a second power connector 135 capable of being connected with the first power connector 131 to receive power, a second signal connector 137 capable of being connected with the first signal connector 133 to receive signals from the body 101, a second supply connector 170 capable of being connected with the first supply connector 150 to receive ink, and a second discharge connector 190 capable of being connected with the first discharge connector 180 to receive the ink discharged from the print head 140.

The head body 141 may include a handle 142 at a front surface of thereof for a manual operation by the user and guide rails 143 which correspond to the guide grooves 117 of the cradle 110 at side surfaces thereof. In exemplary embodiments, the guide rails 143 may extend lengthwise in a substantially horizontal direction of the head body 141 so as to be inserted into and aligned with respect to the guide grooves 117. However, the present general inventive concept is not limited thereto. That is, the guide rails 143 may be provided in various orientations with respect to the head body 141 such that the second connecters 135, 137, 170, and 190 of the print head 140 correspond with the first connectors 131, 133, 150, and 180 of the cradle 110.

In exemplary embodiments, opposite side surfaces of the head body 141 may also be provided with fixing recesses 144 which respectively correspond to the protruding portions 127 of the detaching levers 126. When the print head 140 is coupled into the head mount 114 of the cradle 110, the protruding portions 127, which are inserted into the head mount 114, may be caught by the fixing recesses 144, to thereby prevent the print head 140 from being easily separated from the head mount 114. Although not illustrated, in exemplary embodiments, the head body 141 may be internally defined with ink channels (not illustrated) for movement of the ink. In an exemplary embodiment, the ink channels may connect the head-chip assembly 145, second supply connector 170, and second discharge connector 190 with one another. That is, in exemplary embodiments, the ink channels may be disposed within the image forming apparatus 100 so that the head-chip assembly 145, the second supply connector 170, and the second discharge connecter 190 are in fluid communication with each other.

The head-chip assembly 145 includes a plurality of head chips 146 including the nozzles 146*a*. In the present exemplary embodiment, the image forming apparatus 100 is of an array type, wherein the nozzles 146*a* have a total length which corresponds to a width of a printing medium, such as paper. The plurality of head chips 146 are arranged in rows at a lower surface of the head chip assembly 145. However, the present general inventive concept is not limited thereto. That is, in exemplary embodiments, the plurality of head chips 146 may also be arranged in various other patterns. In the present exemplary embodiment, each of the head-chips 146 include a plurality of nozzles 146*a* to eject ink, and drivers (not illustrated) such as heaters or piezoelectric elements to generate an ink ejection force, to allow ink to be ejected through the nozzles 146*a*. The head-chip assembly 145 may be exposed to an interior of the body 101 through the open bottom of the cradle 110, when the print head 140 is mounted onto the cradle 110.

In exemplary embodiments, the second power connector 135, second signal connector 137, second supply connector 170, and second discharge connector 190 may be arranged substantially horizontal at a rear wall 147 of the head body 141 to respectively correspond to the first power connector 131, first signal connector 133, first supply connector 150, and first discharge connector 180. With this arrangement, the user may couple the second power connector 135, second signal connector 137, second supply connector 170, and second discharge connector 190, with the first power connector 131, first signal connector 133, first supply connector 150, and first discharge connector 180 of the body 101, respectively, by inserting the print head 140 into the head mount 114, without requiring a separate manual operation by the user.

In exemplary embodiments, the rear wall 147 of the head body 141 may be provided with a plurality of coupling recesses 148*a* and 148*b* which correspond to the plurality of coupling protrusions 116*a* and 116*b* of the cradle 110. In exemplary embodiments, when the print head 140 is coupled onto the head mount 114, the coupling protrusions 116*a* and 116*b* are inserted into the respective coupling recesses 148*a* and 148*b*.

In exemplary embodiments, the second power connector 135 includes a plurality of terminal pins 136 for electrical communication. As the plurality of terminal pins 136 are inserted into the plurality of terminal holes 132 of the first power connector 131, the first power connector 131 and second power connector 135 may become mechanically coupled, and at the same time, are may be electrically connected with each other. The second signal connector 137 includes a single terminal 138 for electrical communication. As the terminal 138 is inserted into the terminal hole 134 of the first signal connector 133, the first signal connector 133 and second signal connector 137 may become mechanically and electrically connected with each other.

Figure 8:
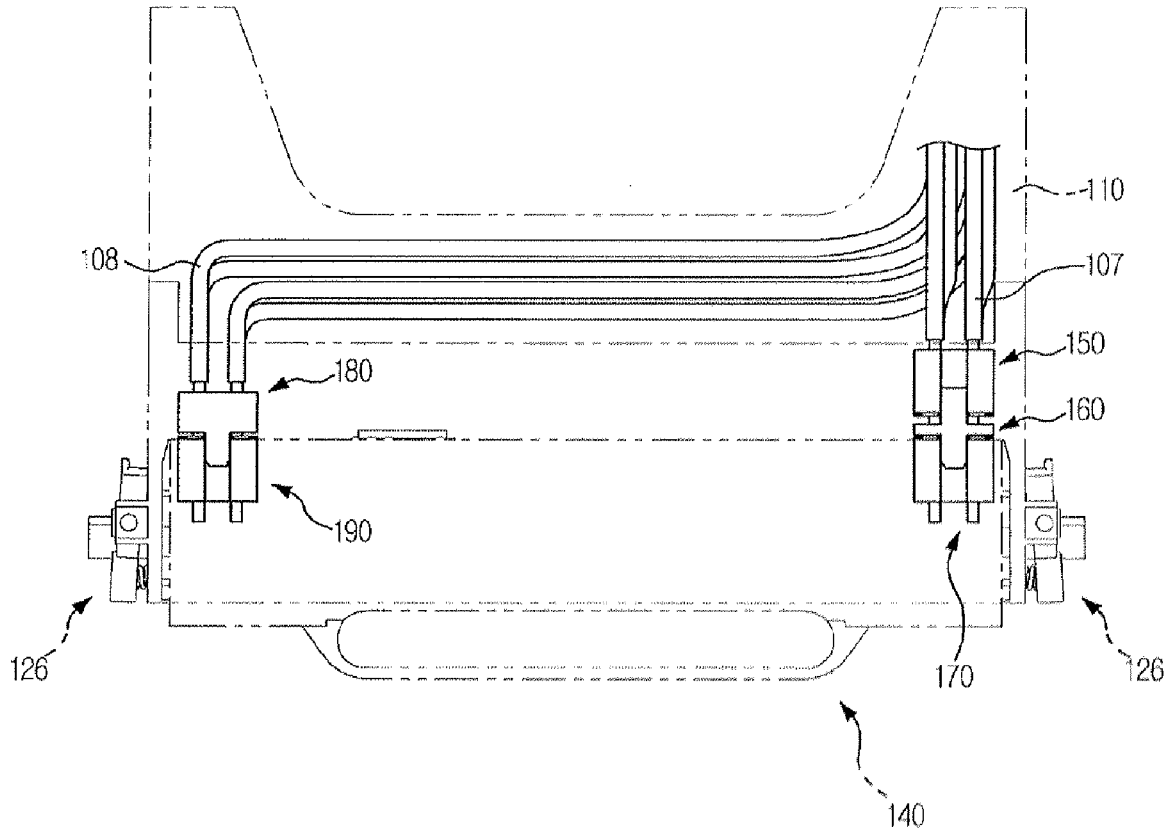
FIG. 8 is a top plan view illustrating a coupled state of the print head and the cradle of the image forming apparatus in accordance with the exemplary embodiment of FIG. 1.

As illustrated in FIG. 8, the second supply connector 170 may be connected with the first supply connector 150 of the body 101, to thereby supply the ink which is stored in the ink tank 102 (see FIG. 4) to the print head 140. The second discharge connector 190 may be connected with the first discharge connector 180 of the body 101, to thereby discharge the ink from the print head 140 to the ink tank 102. The first supply connector 150 may be coupled with a plurality of ink supply tubes 107, which are in turn connected with the regulator 103 (see FIG. 4). The first discharge connector 180 may be coupled with a plurality of ink discharge tubes 108, which are in turn connected with the ink tank 102. In exemplary embodiments, the ink pump 104 may be disposed midway of the ink discharge tubes 108. In the present exemplary embodiment, the second supply connector 170 and the second discharge connector 190 may have substantially similar or the same configuration.

Figure 9:
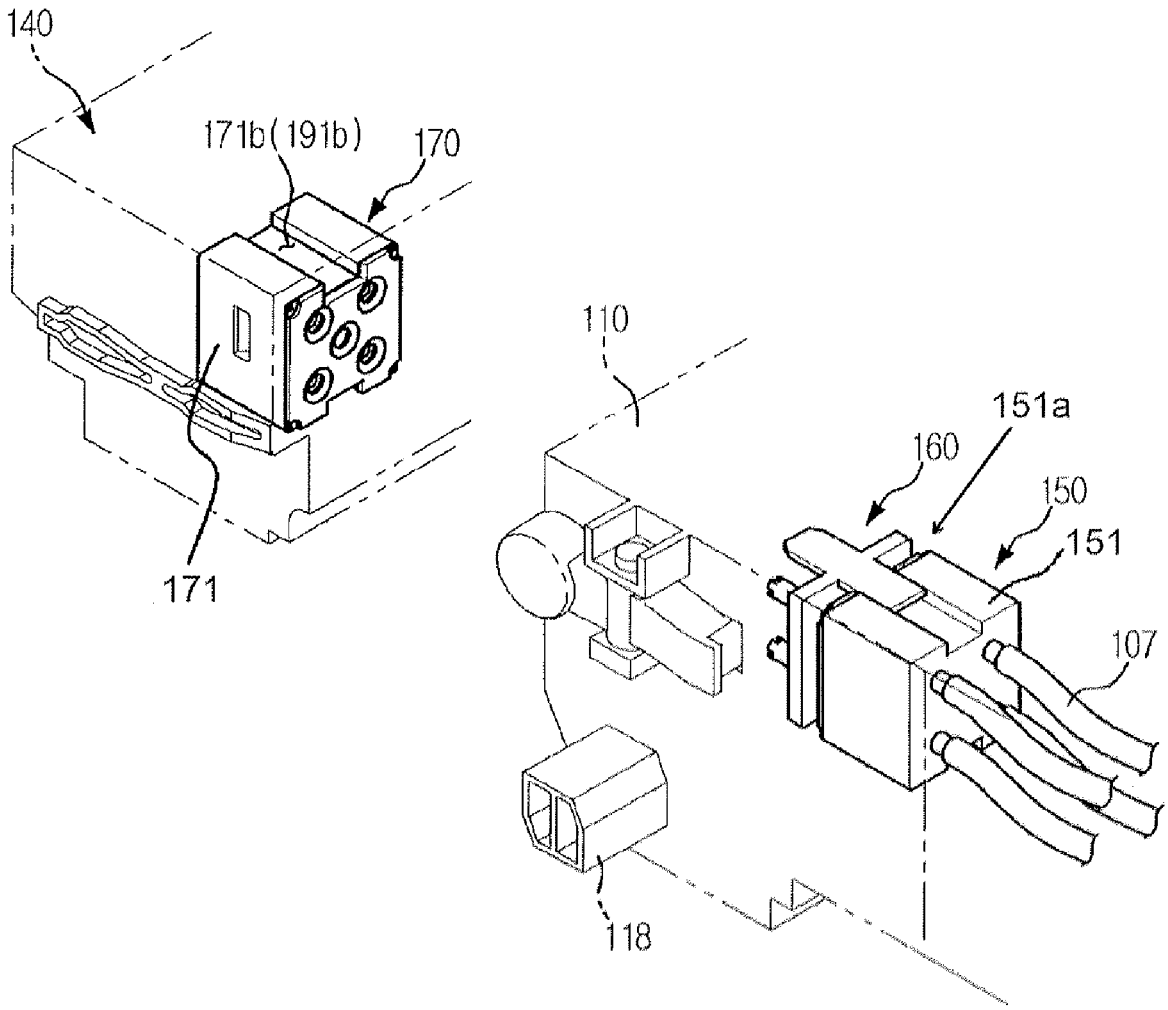
FIG. 9 is a perspective view schematically illustrating first and second supply connectors of the image forming apparatus in accordance with the exemplary embodiment of FIG. 1.

As illustrated in FIG. 9, the first supply connector 150 includes a first connector body 151, which may be coupled to the cradle 110 and may also be connected with the plurality of ink supply tubes 107. In exemplary embodiments, a flow-path connecting device 160 may be installed at a front side 151*a* of the first connector body 151 to thereby connect the first supply connector 150 and second supply connector 170 with each other. The second supply connector 170 includes a second connector body 171, which may be coupled to the print head 140. The second connector body 171 may be provided at a side surface of the print head 140 with a plurality of connecting tubes 172 which are connected to the ink channels (not illustrated) of the print head 140.

Figure 10:
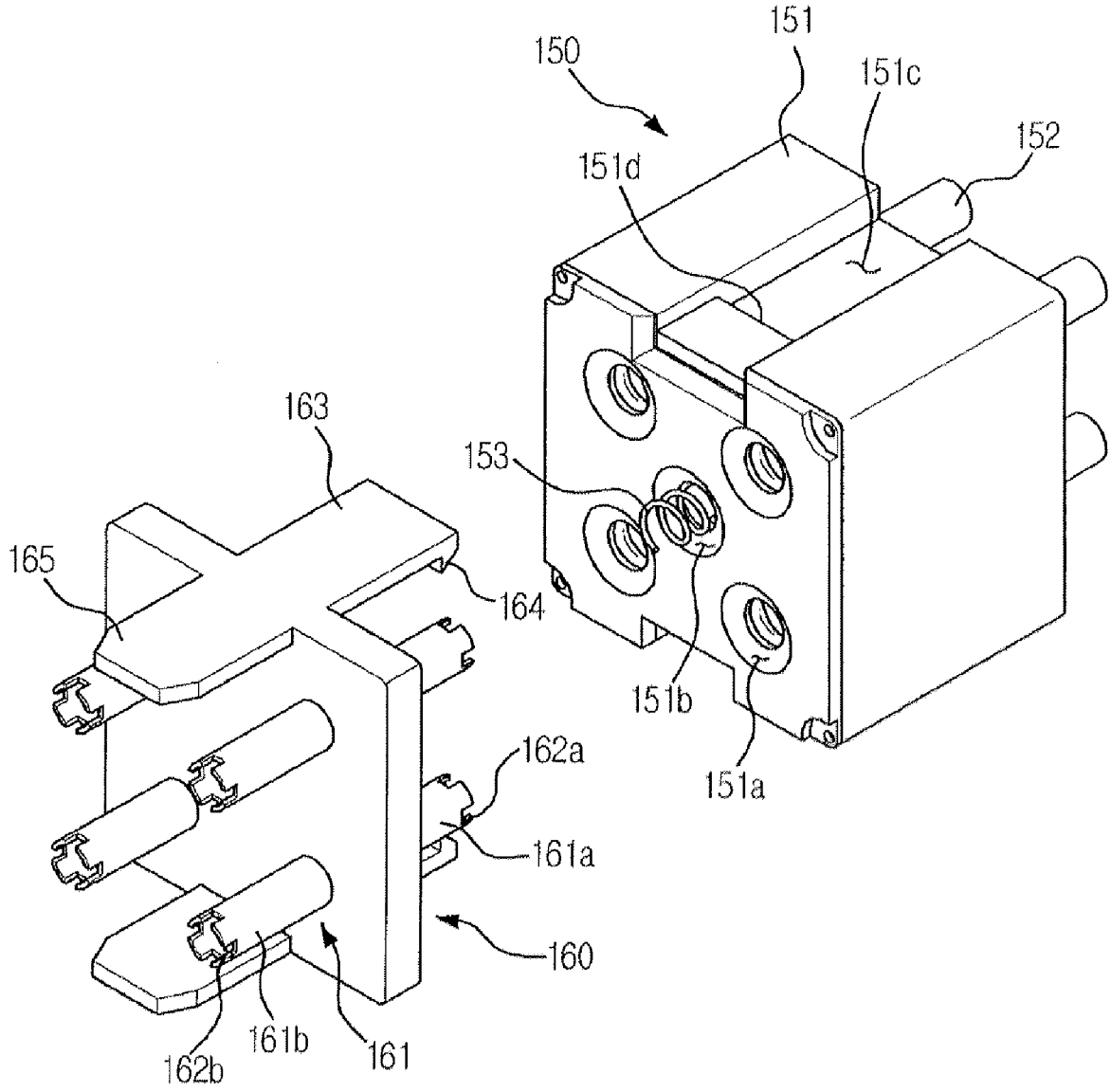
FIG. 10 is a perspective view schematically illustrating a first supply connector and a flow-path connecting device of the image forming apparatus in accordance with the exemplary embodiment of FIG. 1.
Figure 11:
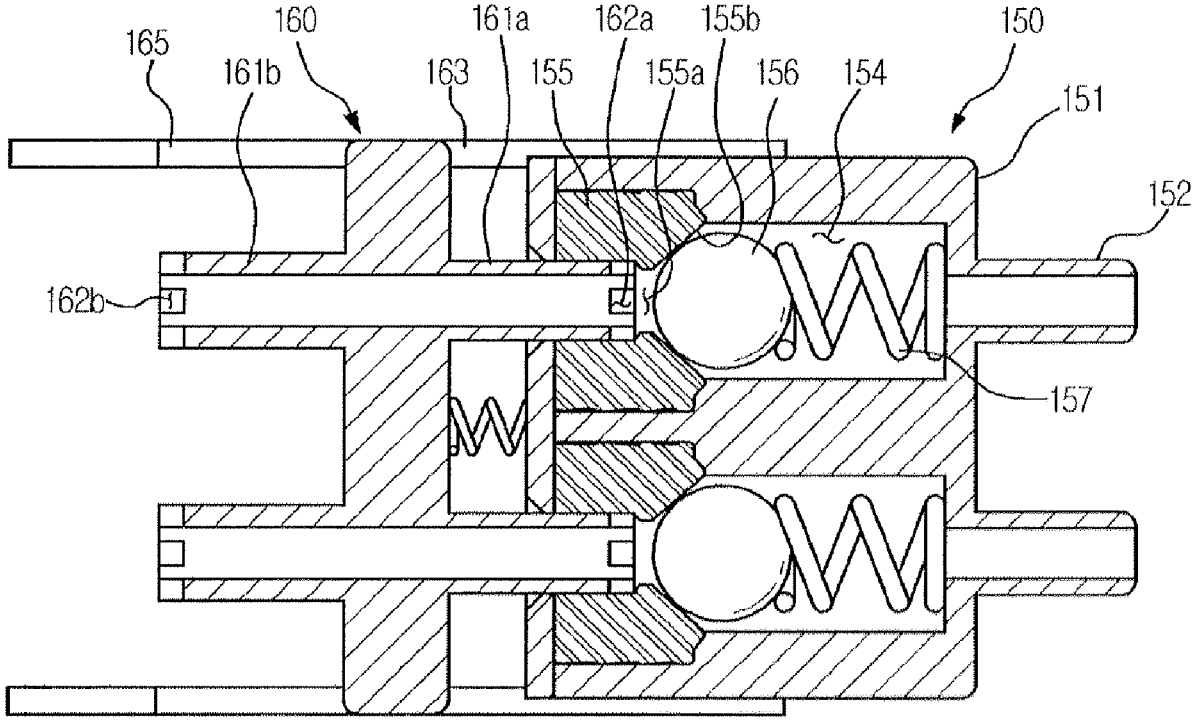
FIG. 11 is a side cross-sectional view schematically illustrating a coupled state of the first supply connector and flow-path connecting device of the image forming apparatus in accordance with the exemplary embodiment of FIG. 1.

As illustrated in FIGS. 10 and 11, the first supply connector 150 includes the first connector body 151, and a plurality of first sealing members 155 and a plurality of first valve members 156 which are installed in the first connector body 151.

As illustrated in FIG. 10, one side surface of the first connector body 151 is provided with a plurality of connecting tubes 152, to which the plurality of ink supply tubes 107 may be coupled. The other side surface of the first connector body 151 may be provided with a plurality of first connecting holes 151*a* which correspond to the plurality of connecting tubes 152, and a mounting recess 151*b*. In exemplary embodiments, the mounting recess 151*b* may be located at approximately a central portion of the first connector body 151, and a return spring 153 may be mounted in the mounting recess 151*b*. The first connector body 151 may include first guide grooves 151*c* which are formed at upper and lower outer surfaces of the first connector body 151. In an exemplary embodiment, each of the first guide grooves 151*c* includes a stepped portion 151*d*.

In exemplary embodiments, the flow-path connecting device 160 may be coupled to the other surface of the first connector body 151 having the first connecting holes 151*a*. The flow-path connecting device 160 may further include a plurality of flow-path tubes 161. Each of the flow-path tubes 161 includes a first tube 161*a*, which protrudes in a rearward direction so as to be inserted into a corresponding one of the plurality of first connecting holes 151*a*, and a second tube 161*b*, which protrudes in a forward direction so as to be connected with the first tube 161*a*. In exemplary embodiments, the first tube 161*a* may be formed with first inlet holes 162*a* at a distal end thereof, and the second tube 161*b* may be formed with second inlet holes 162*b* at a distal end thereof.

In exemplary embodiments, the first tube 161*a* may include a smaller outer diameter than an outer diameter of the second tube 161*b*. The flow-path connecting device 160 may be formed with first guide bars 163, which protrude in the rearward direction similar to the first tubes 161*a*, and second guide bars 165, which protrude in the forward direction similar to the second tubes 161*b*, at the top and bottom surfaces of the flow-path connecting device 160. In exemplary embodiments, each of the first guide bars 163 may be formed with a hook 164 at a distal end thereof. In exemplary embodiments, the hook 164 may correspond with the first guide grooves 151*c* and stepped portion 151*d* of the first supply connector 150.

The pair of first guide bars 163 may be inserted into the pair of first guide grooves 151*c*, respectively, in a slidably movable manner. When the flow-path connecting device 160 moves forward and thereby becomes more distant from the first supply connector 150, the first guide bars 163 slidably move along the respective first guide grooves 151*c*. However, if the hooks 164 of the first guide bars 163 are caught by the stepped portions 151*d* of the first guide grooves 151*c* as the first guide bars 163 move forward, the first guide bars 163 are stopped and therefore cannot move any further. In exemplary embodiments, as the hooks 164 of the first guide bars 163 are caught by the stepped portions 151*d*, the flow-path connecting device 160 cannot be separated from the first supply connector 150. However, the present general inventive concept is not limited thereto. That is, in alternative exemplary embodiments, the hooks 164 may be separated from the first supply connector 150, such that the flow-path connecting device 160 may be easily removed from the first supply connector 150.

When the flow-path connecting device 160 is coupled to the first supply connector 150, the return spring 153, which is installed at the other side surface of the first connector body 151, may apply an elastic force onto the flow-path connecting device 160. In exemplary embodiments, the plurality of first tubes 161*a* of the flow-path connecting device 160 are maintained at positions separated from the plurality of first connecting holes 151*a* of the first connector body 151 by the elastic force of the return spring 153.

As illustrated in FIG. 11, the first connector body 151 includes a plurality of internally defined first chambers 154, through which the plurality of connecting tubes 152 and the plurality of connecting holes 151*a* are connected to each other. The ink, which is supplied through the connecting tubes 152, may move toward the first connecting holes 151*a* through the first chambers 154. The first sealing members 155 are installed between the first chambers 154 and the first connecting holes 151*a*. Each of the first sealing members 155 includes a first orifice 155*a* for a movement of ink, and a first seat 155*b* to come into close contact with the first valve member 156 to thereby close the first orifice 155*a*. In exemplary embodiments, the first sealing member 155 is made of an elastic material, such as rubber or silicone. If the first valve member 156 comes into close contact with the first seat 155*b*, the first orifice 155*a* is closed, which thereby prevents the movement of ink.

In exemplary embodiments, the plurality of first valve members 156 are movably installed in the respective first chambers 154 such that they are selectively brought into contact with or separated from the respective first sealing members 155. Each of the first chambers 154 is provided with a first valve spring 157 which is used to cause the first valve member 156 to come into close contact with the first seat 155*b* of the first sealing member 155. However, if the first tubes 161*a* of the flow-path connecting device 160 are not inserted into the first chambers 154, the first valve members 156 come into close contact with the first seats 155*b*, to thereby prevent the movement of ink through the first orifices 155*a*.

Figure 12:
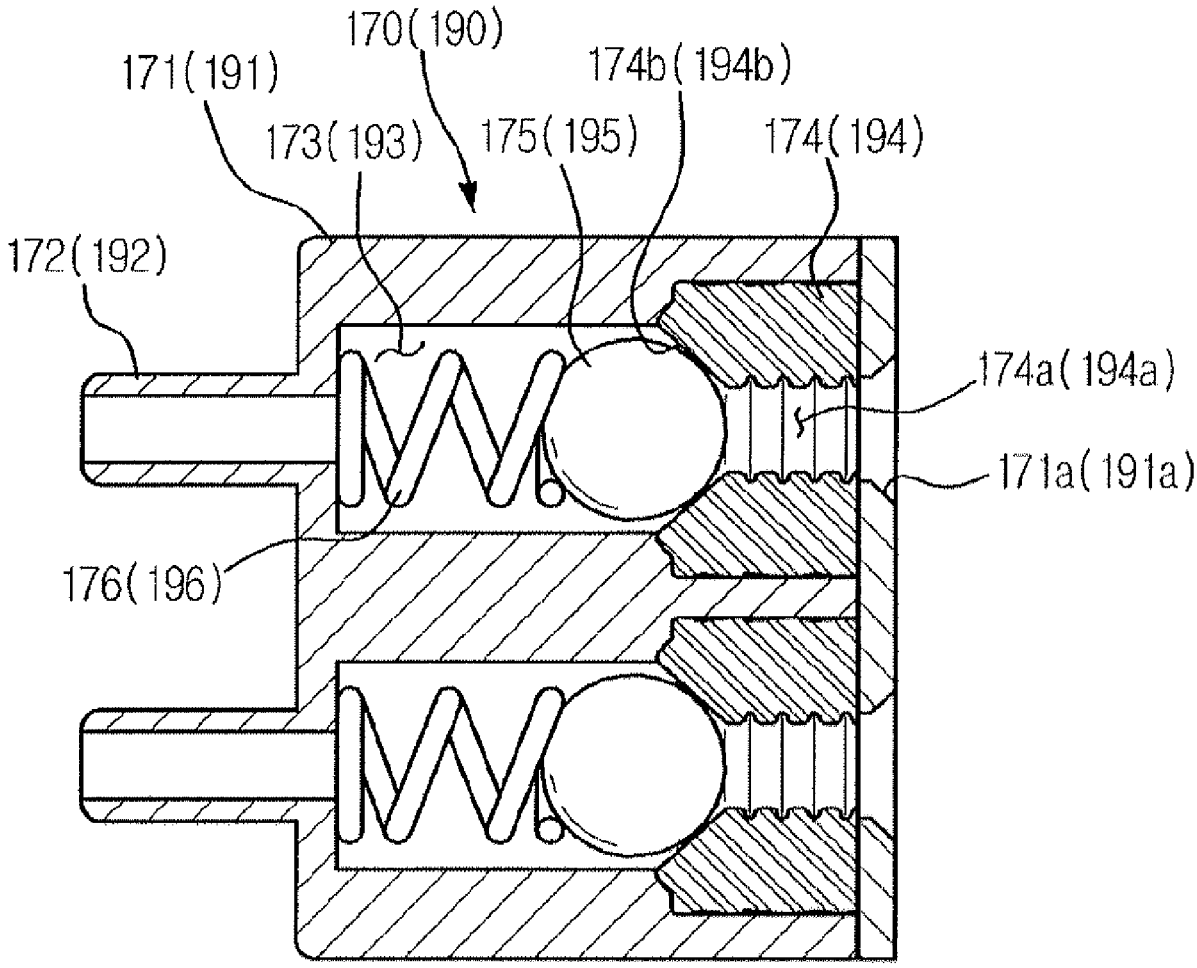
FIG. 12 is a side cross-sectional view schematically illustrating a second supply connector of the image forming apparatus in accordance with the exemplary embodiment of FIG. 1.

As illustrated in FIG. 12, the second supply connector 170 includes the second connector body 171, and a plurality of second sealing members 174 and a plurality of second valve members 175 which are installed in the second connector body 171.

The plurality of connecting tubes 172 are provided at one side surface of the second connector body 171, and a plurality of second connecting holes 171*a* are formed at the other side surface of the second connector body 171 to correspond to the plurality of connecting tubes 172. The second connector body 171 includes second guide grooves 171*b* (see FIG. 9) formed at upper and lower outer surfaces thereof, such that the second guide bars 165 of the flow-path connecting device 160 are slidably movably inserted into the second guide grooves 171*b*. When the second supply connector 170 is coupled with the flow-path connecting device 160, the second guide bars 165 are inserted into the second guide grooves 171*b* to slidably move along the second guide grooves 171*b*, to thereby allow for a stable coupling of the second supply connector 170 and the flow-path connecting device 160.

As illustrated in FIG. 12, the second connector body 171 includes a plurality of internally defined second chambers 173, through which the plurality of connecting tubes 172 and the plurality of connecting holes 171*a* are connected to each other. The plurality of second sealing members 174 are installed between the second chambers 173 and the second connecting holes 171*a*. Each of the second sealing members 174 includes a second orifice 174*a* for a movement of ink, and a second seat 174*b* to come into close contact with the second valve member 175 to thereby close the second orifice 174*a*. In exemplary embodiments, the second sealing member 174 is made of an elastic material, such as rubber or silicone, similar to the first sealing member 155.

The plurality of second valve members 175 are movably installed in the respective second chambers 173 such that they are selectively brought into contact with or separated from the respective second sealing members 174. Each of the second chambers 173 is provided with a second valve spring 176, which is used to cause the second valve member 175 to come into close contact with the second seat 174*b* of the second sealing member 174. However, if the second tubes 161*b* do not push the second valve members 175, the second valve members 175 come into close contact with the second seats 174*b*, to thereby prevent a movement of ink through the second orifices 174*a*.

In exemplary embodiments, the second sealing members 174 of the second supply connector 170 may include a larger hardness value than that of the first sealing members 155 of the first supply connector 150. Therefore, when the first supply connector 150 and second supply connector 170 are disconnected from each other, in consideration of the larger hardness value of the second sealing members 174 than that of the first sealing members 155, the second tubes 161*b* must be separated from the second chambers 173 after the first tubes 161*a* are separated from the first chambers 154. That is, since the second sealing members 174 is harder than the first sealing members 155, the first tubes 161*a* would separate from the first chambers 154 prior to the second tubes 161*b* separation from the second chambers 173.

Upon disconnection of the first supply connector 150 from the second supply connector 170, if the second tubes 161*b* are first separated from the second chambers 173 in a state wherein the first tubes 161*a* are still inserted in the first chambers 154, there remains a risk of air from an external environment being introduced into the regulator 103 through the flow-path tubes 161, first chambers 154, connecting tubes 152, and ink supply tubes 107. In this case, negative pressure of ink in the regulator 103 is eliminated, causing a predetermined amount of ink to be sprayed through the nozzles 146*a* of the print head 140 when the first supply connector 150 and second supply connector 170 are re-connected to each other. Therefore, upon disconnection of the first supply connector 150 from the second supply connector 170, it is important that the second tubes 161*b* be separated from the second chambers 173 of the second supply connector 170 after the first tubes 161*a* are separated from the first chambers 154 of the first supply connector 150.

Further, in consideration of the larger hardness value of the second sealing members 174 than that of the first sealing members 155, when the first supply connector 150 and second supply connector 170 are connected to each other via the flow-path connecting device 160, the second tubes 161*b* must be connected to the second chambers 173 after the first tubes 161*a* are connected to the first chambers 154. However, if the first tubes 161*a* are connected to the first chambers 154 after the second tubes 161*b* are connected to the second chambers 173, there remains a risk of air from the external environment being introduced into the print head 140 through the flow-path tubes 161, second chambers 173, and connecting tubes 172.

There are a variety of methods to ensure that a force required to connect or disconnect the first tubes 161*a* to or from the first chambers 154 is lower than a force required to connect or disconnect the second tubes 161*b* to or from the second chambers 173. For example, in exemplary embodiments, as described above, when the second tubes 161*b* have a larger outer diameter than that of the first tubes 161*b*, the second tubes 161*b* may be separated from the second chambers 173 after the first tubes 161*a* are separated from the first chambers 154. In alternative exemplary embodiments, the first and second tubes 161*a* and 161*b* may have a substantially similar or the same outer diameter, however the first orifice 155*a* may have a larger diameter than that of the second orifice 174*a*.

In exemplary embodiments, the second discharge connector 190 includes a substantially similar or the same configuration as the second supply connector 170. In an exemplary embodiment, the second discharge connector 190, as illustrated in FIG. 12, includes a third connector body 191 having a plurality of third connecting holes 191*a* and a plurality of third chambers 193, and a plurality of third sealing members 194 and a plurality of third valve members 195 which are installed in the plurality of third chambers 193. Each of the third sealing members 194 includes a third orifice 194*a* and a third seat 194*b*. In exemplary embodiments, each of the third chambers 193 may be provided with a third valve spring 196 which is used to push the third valve member 195 so as to cause the third valve member 195 to come into close contact with the third seat 194*b*, thereby preventing a movement of ink through the third orifices 194*a*.

A plurality of connecting tubes 192 are provided at one side surface of the third connector body 191. In exemplary embodiments, the third connector body 191 may also include a pair of third guide grooves 191*b* (see FIG. 9) formed at upper and lower outer surfaces of the third connector body 191.

Figure 13:
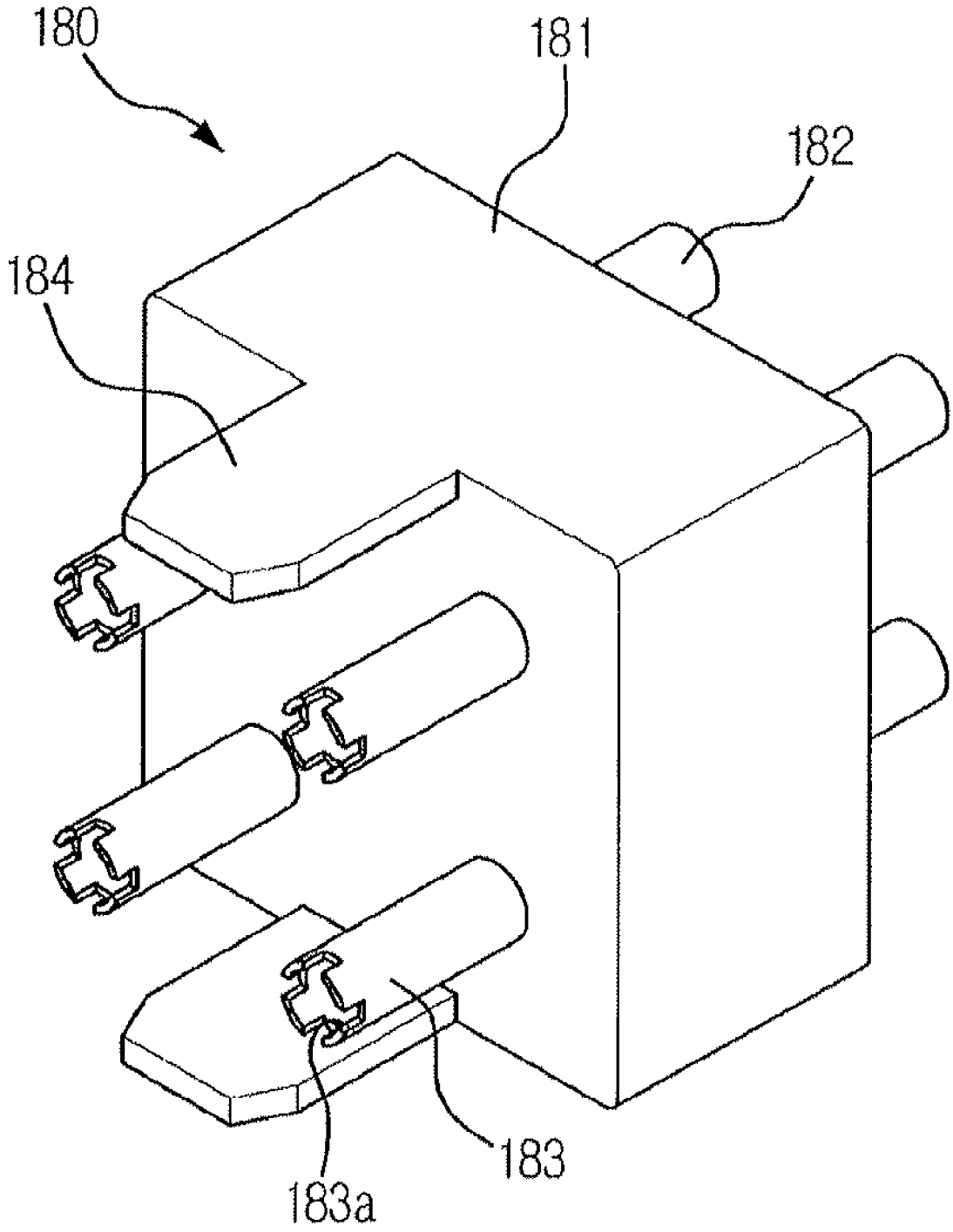
FIG. 13 is a perspective view schematically illustrating a second supply connector of the image forming apparatus in accordance with the exemplary embodiment of FIG. 1.

As illustrated in FIG. 13, the first discharge connector 180 includes a fourth connector body 181 coupled into the cradle 110, a plurality of connecting tubes 182 protruding from one side surface of the fourth connector body 181 so as to be coupled with the plurality of ink discharge tubes 108 (see FIG. 3), and a plurality of insertion tubes 183 protruding from the other side surface of the fourth connector body 181 to correspond to the plurality of connecting tubes 182. In exemplary embodiments, each of the insertion tubes 183 includes third inlet holes 183*a*, which are formed at a distal end of the insertion tubes 183, through which the ink of the third chamber 193 may be introduced into the insertion tube 183 when the insertion tube 183 is inserted into the third chamber 193 by pushing the third valve member 195 of the second discharge connector 190.

In exemplary embodiments, a pair of guide bars 184 protrudes from the top and bottom of the other side surface of the fourth connector body 181, such that they are slidably and movably inserted into the pair of guide grooves 191*b* of the third connector body 191. When the first discharge connector 180 and second discharge connector 190 are coupled with each other, the pair of guide bars 184 which are provided at the first discharge connector 180 slidably move along the pair of third guide grooves 191*b* provided at the second discharge connector 190, to thereby allow for a stable coupling of the first discharge connector 180 and second discharge connector 190.

Hereinafter, an exemplary embodiment of a sequence used to couple the print head 140 into the cradle 110 will be described with reference to the accompanying drawings.

In exemplary embodiments, to mount the print head 140 into the cradle 110, as illustrated in FIGS. 1, 2, and 3, the cradle 110 is first moved to an open position (see FIG. 2). If the print head 140 is pushed into the head mount 114 of the cradle 110 at the open position of the cradle 110, the guide rails 143 (see FIG. 4) of the print head 140 move along the guide grooves 117 of the cradle 110, and the print head 140 is thereby aligned and linearly moved and inserted into the head mount 114.

Figure 14:
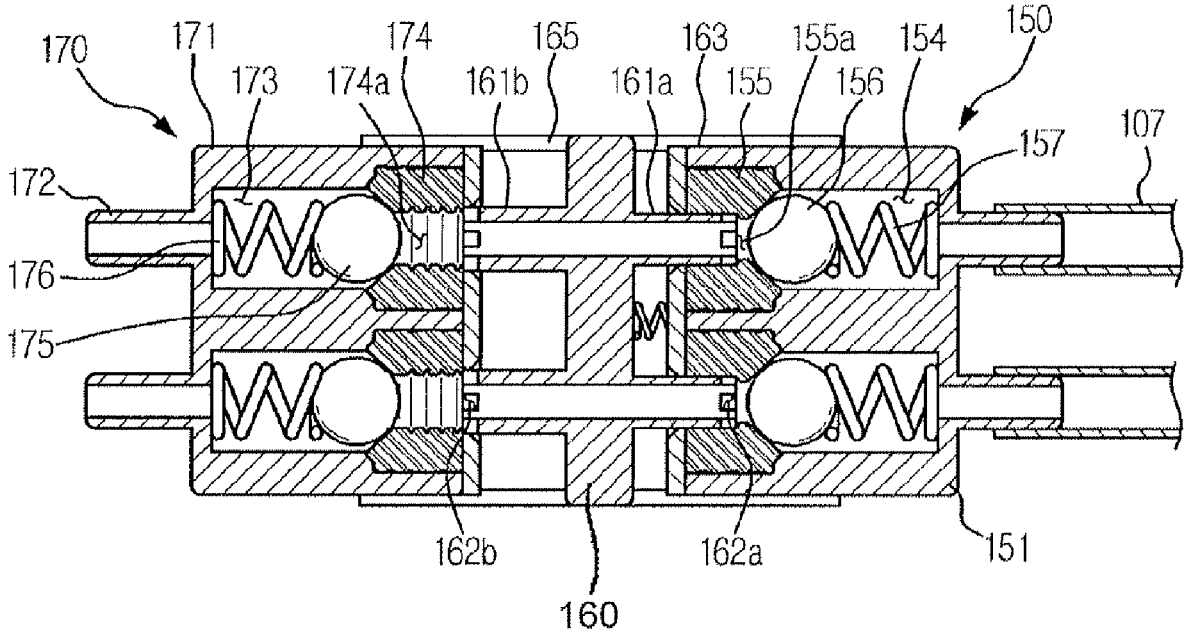
FIG. 14 is a perspective view schematically illustrating a first discharge connector of the image forming apparatus in accordance with the exemplary embodiment of FIG. 1.

As the print head 140 is pushed into the head mount 114, the second tubes 161*b* (see FIG. 10) of the flow-path connecting device 160 come into contact with the second sealing members 174 of the second supply connector 170 through the second connecting holes 171*a*. In an exemplary embodiment, end portions of the second tubes 161*b* come into contact with the second sealing members 174. Then, if the print head 140 is pushed further, as illustrated in FIG. 14, the flow-path connecting device 160 is pushed toward the first supply connector 150, and the first tubes 161*a* are thereby inserted into the first orifices 155*a* of the first sealing members 155. In this case, since a hardness of the second sealing members 174 is larger than that of the first sealing members 155 and an outer diameter of the second tubes 161*b* is larger than that of the first tubes 161*a*, the second tubes 161*b* cannot be inserted into the second orifices 174*a* of the second sealing members 174 while the first tubes 161*a* are being inserted into the first orifices 155*a*. That is, in exemplary embodiments, the second tubes 161*b* cannot be inserted into the second orifices 174*a* of the second sealing members 174 until the first tubes 161*a* are inserted into the first orifices 155*a*.

Figure 15:
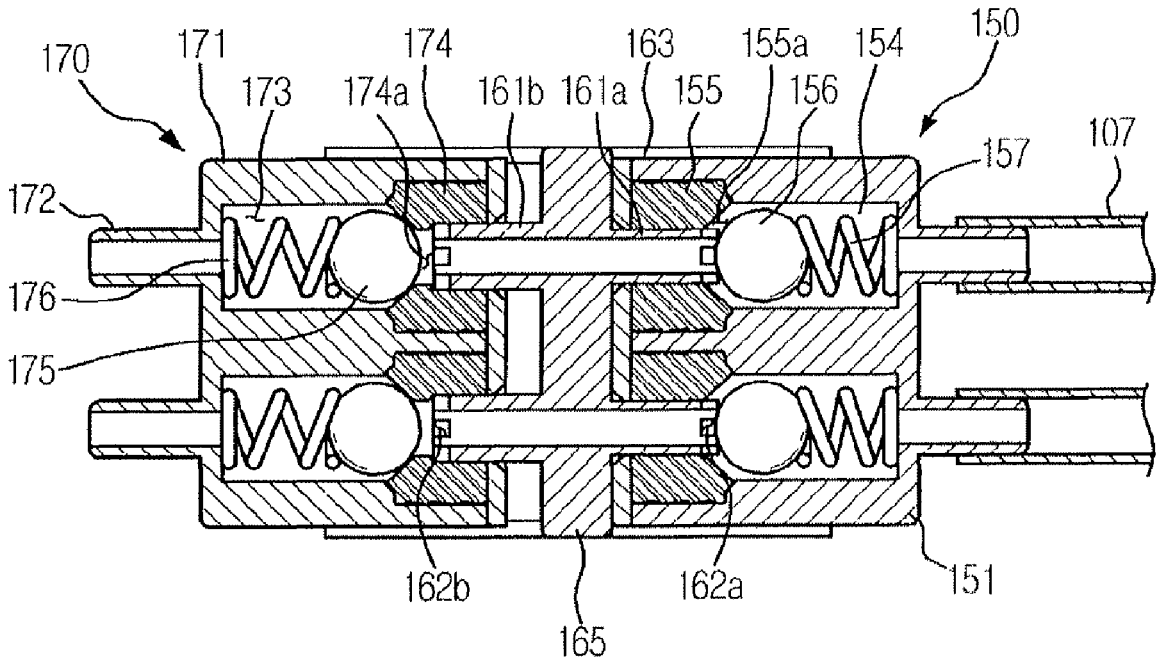
FIGS. 15 and 16 are side cross-sectional views illustrating a sequence to couple the print head into the cradle of the image forming apparatus in accordance with the exemplary embodiment of the present invention.

If the print head 140 is further inserted into the head mount 114, as illustrated in FIG. 15, the first tubes 161*a* are inserted into the first chambers 154 through the first orifices 155*a* by pushing the first valve members 156. In this case, the ink in the first chambers 154 may be introduced into the first tubes 161*a* through the first inlet holes 162*a* which are formed at ends of the respective first tubes 161*a*. As the first tubes 161*a* are inserted into the first chambers 154, the second tubes 161*b* are inserted into the second orifices 174*a* of the second sealing members 174.

Figure 16:
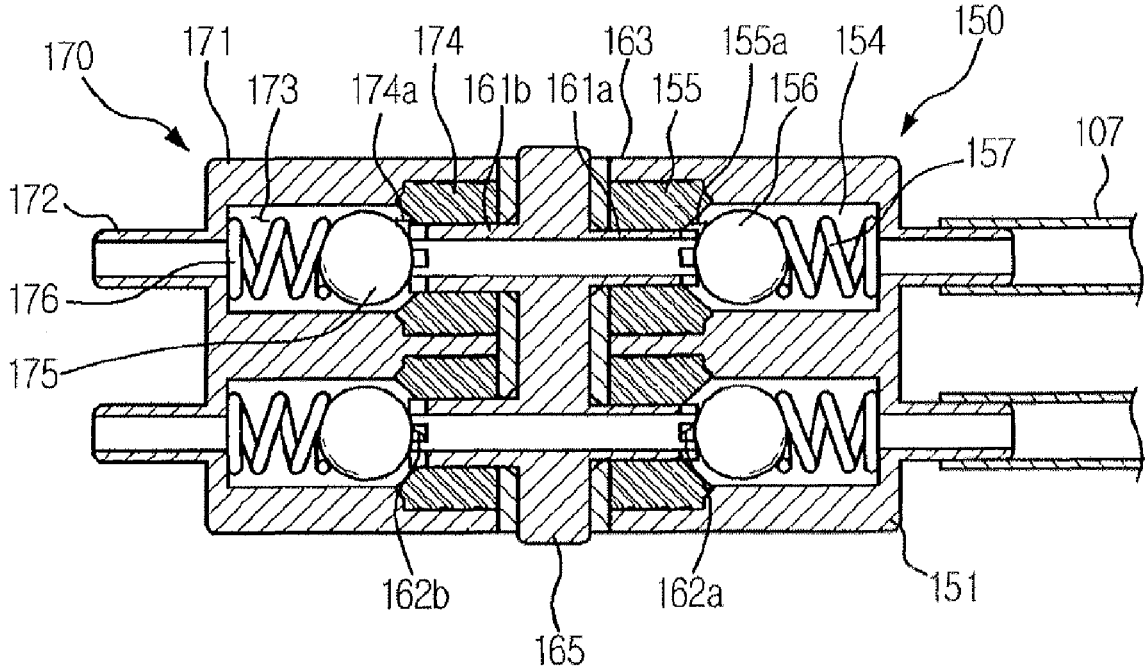

Finally, after the print head 140 is completely inserted into the head mount 114, as illustrated in FIG. 16, the second tubes 161*b* are inserted into the second chambers 173 through the second orifices 174*a* by pushing the second valve members 175. In this case, the first chambers 154 and the second chambers 173 are connected to each other via the flow-path connecting device 160. The ink introduced into the first tubes 161*a* moves through the second tubes 161*b*, thereby being introduced into the second chambers 173 through the second inlet holes 162*b*, which are formed at the end of the respective second tubes 161*b*. Accordingly, in exemplary embodiments, the ink in the ink tanks 102 may be supplied into the print head 140.

During a connection of the first supply connector 150 with the second supply connector 170, the insertion tubes 183 of the first discharge connector 180 are inserted into the third chambers 193 through the third orifices 194*a* of the second discharge connector 190. Accordingly, the first discharge connector 180 and second discharge connector 190 may be connected to each other to allow a movement of ink therethrough.

After the print head 140 is completely mounted in the cradle 110, the first power connector 131 and first signal connector 133, which are provided at the cradle 110, are coupled with the second power connector 135 and second signal connector 137 of the print head 140, respectively, in order to supply power and signals to the print head 140. Then, as the protruding portions 127 (see FIG. 6) of the detaching levers 126, which are provided at the cradle 110, are inserted into the fixing recesses 144 of the print head 140, the print head 140 cannot be easily separated from the cradle 110. However, the present general inventive concept is not limited thereto. That is, in exemplary embodiments, various other methods may be used to fasten the print head 140 to the cradle 110. For example, in an exemplary embodiment, a mechanical or magnetic mechanism (not illustrated) may be used to securely fasten the print head 140 to the cradle 110.

As described above, in the image forming apparatus 100 of the present general inventive concept, the second power connector 135 and second signal connector 137 of the print head 140 may be connected with the first power connector 131 and first signal connector 133 of the body 101 by simply inserting the print head 140 into the head mount 114 of the cradle 110. Accordingly, an easy installation and/or separation of the print head 140 may be achieved.

Also, in the image forming apparatus 100 of the present general inventive concept, the cradle 110 may be moved in an upward direction away from the body 101 by a predetermined distance. Accordingly, when moving the cradle 110 to the open position, it may be easy to insert and/or separate the print head 140 into or from the cradle 110. Further, even if a printing medium, such as paper, is jammed in the image forming apparatus 100 during a printing operation thereof, it is possible to easily remove the jammed printing medium from the body 101 by moving the cradle 110 to the open position, which thereby exposes the top of the body 101 to the external environment.

In the image forming apparatus 100 according to the present general inventive concept, the ink tank 102 and regulator 103 may be installed in the body 101, and the print head 140 may be detachably installed to the body 101, without the ink tank 102 and regulator 103. With this configuration, it is possible to replace only the print head 140, without disposing the ink tank 102 and regulator 103. Accordingly, maintenance costs of the image forming apparatus 100 may be reduced.

Also, when the print head 140 is separated from the body 101, or re-installed into the body 101, the regulator 103 may be connected with the print head 140 while maintaining an initial negative pressure therein by virtue of an interaction of the first supply connector 150 and second supply connector 170. Accordingly, the image forming apparatus 100 of the present general inventive concept may prevent or substantially reduce air from an external environment from entering the ink which is to be supplied into the print head 140, and may prevent or substantially reduce leakage of ink caused upon a release of the negative pressure inside the regulator 103.

In the image forming apparatus 100 of the present general inventive concept, the first power connector 131, second power connector 135, first signal connector 133, and second signal connector 137 may be arranged substantially perpendicular to the body 101 with respect to a bottom surface of the body 101. With the arrangement of the connectors 131, 135, 133, and 137, the print head 140 having the second power connector 135 and second signal connector 137 may be configured to have a minimum compact size, and thus, may be manufactured with reduced material costs.

As apparent from the above description, in the image forming apparatus according to exemplary embodiments of the present general inventive concept, a regulator is mounted in a body and thus, may remain within the body even upon an exchange of a print head, thereby resulting in a reduction in maintenance costs of the image forming apparatus.

Further, according to the present exemplary embodiment of the present general inventive concept, an ink tank is mounted in the body. Accordingly, the ink tank may be formed to a sufficiently large size and consequently, an exchange period of the ink tank may be lengthened.

Furthermore, in the image forming apparatus according to an exemplary embodiment of the present general inventive concept, a print head is mounted to a head mount such that a first power connector, first signal connector, first supply connector, and first discharge connector, which are provided at the head mount are respectively connected with a second power connector, second signal connector, second supply connector and second discharge connector which are provided at the print head, whereby an efficient transmission of power and signals to the print head as well as an efficient supply and discharge of ink may be assured, thereby resulting in an easy installation and/or separation of the print head.

Although some exemplary embodiments of the present general inventive concept have been illustrated and described, it would be appreciated by those skilled in the art that various changes may be made in these exemplary embodiments without departing from the principles and spirit of the present general inventive concept, the scope of which is defined in the claims and their equivalents.

What is claimed is:

1. An image forming apparatus, comprising:

a body;

a print head including a nozzle part having a length equal to or greater than a width of a print medium and detachably mounted onto the body;

an ink tank mounted onto the body to store the ink which is to be supplied to the print head; and a regulator provided apart from the print head and the ink tank and mounted onto the body even when the print head is detached from the body, the regulator to adjust a negative pressure of ink as it flows through the regulator to be supplied to the print head when the print head is attached to the body.

2. The apparatus according to claim 1, further comprising:

an ink pump mounted onto the body to withdraw the ink from the print head.

3. The apparatus according to claim 1, further comprising:

a head mount provided at the body to mount the print head;

at least one first connector provided at the head mount; and at least one second connector provided at the print head to correspond to the at least one first connector.

4. The apparatus according to claim 3, wherein the first connector and second connector are connected to each other when the print head is mounted to the head mount.

5. The apparatus according to claim 3, wherein the first connector includes at least one of a first power connector to supply power to the print head, a first signal connector to transmit signals to the print head, a first supply connector which is connected with an ink supply tube for supply of the ink, and a first discharge connector connected with an ink discharge tube to discharge the ink of the print head.

6. The apparatus according to claim 5, wherein the second connector includes at least one of a second power connector connected with the first power connector to receive or transmit power therebetween, a second signal connector connected with the first signal connector to receive or transmit signals therebetween, a second supply connector connected with the first supply connector to supply ink into the nozzle part, and a second discharge connector connected with the first discharge connector to receive ink transmitted thereto.

7. The apparatus according to claim 6, wherein the second discharge connector includes a third connector body having a third chamber and a third sealing member installed in the third connector body and having a third orifice connected with the third chamber, and the first discharge connector includes an insertion tube to be inserted into the third orifice to thereby be connected with the third chamber.

8. The apparatus according to claim 7, wherein a third valve member to open or close the third orifice and a third valve spring to press the third valve member so as to cause the third valve member to come into contact with the third sealing member are installed in the third chamber.

9. The apparatus according to claim 5, wherein the first supply connector includes a first connector body having a first chamber and a first sealing member installed in the first connector body and having a first orifice connected with the first chamber, the second supply connector includes a second connector body having a second chamber and a second sealing member installed in the second connector body and having a second orifice connected with the second chamber, and a flow-path connecting device installed between the first connector body and the second connector body and includes a flow-path tube having a first end inserted into the first orifice to thereby be connected with the first chamber and a second end inserted into the second orifice to thereby be connected with the second chamber.

10. The apparatus according to claim 9, wherein a first valve member to open or close the first orifice and a first valve spring to press the first valve member so as to cause the first valve member to come into contact with the first sealing member are installed in the first chamber, and a second valve member to open or close the second orifice and a second valve spring to press the second valve member so as to cause the second valve member to come into contact with the second sealing member are installed in the second chamber.

11. An image forming apparatus, comprising:

a body;

a print head including a nozzle part having a length greater than or equal to a width of a print medium;

a cradle pivotally and/or rotatably mounted in the body to receive the print head when mounting the print head to the body;

an ink tank provided apart from the print head and mounted to the body even when the print head is detached from the body, in which ink is stored; and a regulator provided apart from the print head and mounted in the body, the regulator to adjust a negative pressure of the ink which is to be supplied from the ink tank to the print head when the print head is attached to the body.

12. The apparatus according to claim 11, further comprising:

a head mount provided at the cradle to mount the print head;

a plurality of first connectors provided at the head mount; and a plurality of second connectors provided at the print head to correspond with the plurality of first connectors.

13. The apparatus according to claim 12, wherein the first connector and second connector are connected with each other as the print head is mounted to the head mount.

14. The apparatus according to claim 12, wherein the first connectors include at least one of a first supply connector to supply the ink to the print head, and a first discharge connector to withdraw the ink from the print head.

15. The apparatus according to claim 14, wherein the second connector includes at least one of a second supply connector connected with the first supply connector to receive the ink supplied thereinto, and a second discharge connector connected with the first discharge connector to receive the ink discharged from the print head.

16. A printhead usable with an image forming apparatus having an ink tank and/or a regulator, the printhead comprising:

a first ink supply connector which includes a first valve member accessible through a first orifice within the first ink supply connector, the first valve member being movable between a first position and a second position, the first position prevents ink communication between the printhead and the ink tank via the first ink supply connector and the second position allows ink communication between the printhead and the ink tank via the first ink supply connector, such that an insertion of the printhead onto the image forming apparatus provides ink communication between the printhead and the image forming apparatus;

a second ink supply connector coupled to the image forming apparatus to mirror the first ink supply connector, comprising a second valve member accessible through a second orifice; and a flow-path connecting device slidably attached to the first ink supply connector, the flow-path connecting device comprising at least one connecting tube having a first end inserted into the first orifice and a second end inserted into the second orifice to attach the print head to the body.

17. The printhead of claim 16, wherein the insertion of the printhead onto the image forming apparatus moves the first valve member from the first position to the second position.

18. The printhead of claim 16, wherein the insertion of the printhead onto the image forming apparatus moves the first valve member from the first position to the second position by using at least one connecting tube of the plurality of connecting tubes.

19. The printhead of claim 16, further comprising:

at least one electrical connector disposed on a same side as the first ink supply connector, wherein the insertion of the printhead onto the image forming apparatus simultaneously provides ink and electrical communication between the printhead and the image forming apparatus.

20. The printhead of claim 19, wherein the first ink supply connector includes an ink supply connector and an ink discharge connector, and the at least one electrical connector includes a signal connector and a power connector, wherein the insertion of the printhead onto the image forming apparatus simultaneously provides ink and electrical communication between the printhead and the image forming apparatus via the ink supply connector, the ink discharge connector, the signal connector, and the power connector, respectively.

21. The printhead of claim 19, further comprising:

guide rails corresponding to guide grooves of the image forming apparatus, wherein the insertion of the printhead onto the image forming apparatus includes aligning the guide rails of the printhead with the guide grooves of the image forming apparatus.

22. A method of manufacturing an image forming apparatus, the method comprising:

disposing a body having a receiving unit coupled with the body, a receiving space, and a first connector installed in the receiving space and having a first orifice;

disposing a print head detachably installed in the receiving space and including a head chip to eject ink and a second connector having a second orifice corresponding to the first orifice of the first connector;

disposing a flow-path connecting device installed between the first connector body and the second connector body, comprising a flow-path tube having a first end inserted into the first orifice and a second end inserted into the second orifice to attach the print head to the body; and disposing a regulator to adjust a negative pressure of the ink as it flows through the regulator to be supplied to the print head when the print head is attached to the body, the first connector and the second connector connecting to each other as the print head is inserted into the receiving space.

23. An image forming apparatus, comprising:

a body comprising at least one first connector body having at least one first orifice;

a print head, comprising:

a nozzle part having a length equal to or greater than a width of a print medium, and at least one second connector body having at least one second orifice to correspond to the at least one first orifice;

a flow-path connecting device installed between the first connector body and the second connector body, comprising a flow-path tube having a first end inserted into the first orifice and a second end inserted into the second orifice to attach the print head to the body; and a regulator to adjust a negative pressure of ink which is to be supplied to the print head from an ink tank when the print head is attached to the body, the print head being removable from the body without removing at least one of the ink tank and the regulator.

24. An image forming apparatus, comprising:

a body;

a print head including a nozzle part having a length greater than or equal to a width of a print medium;

a regulator mounted on the body to adjust a negative pressure of ink which is to be supplied the print head when the print head is attached to the body; and a cradle pivotally and/or rotatably mounted on the body to allow the print head to couple to and detach from the body without attaching or removing the regulator from the body.

25. The image forming apparatus of claim 24, further comprising:

an ink tank mounted on the body to store and supply the ink to the regulator regardless of whether the print head is coupled to the body.

26. An image forming apparatus, comprising:

a body comprising at least one first connector body having at least one first orifice;

a print head detachably mounted on the body, comprising:

a nozzle part having a length greater than or equal to a width of a print medium, at least one second connector body having at least one second orifice to correspond to the at least one first orifice;

a flow-path connecting device installed between the first connector body and the second connector body, comprising a flow-path tube having a first end inserted into the first orifice and a second end inserted into the second orifice to attach the print head to the body; and a regulator fixed to the body to adjust a negative pressure of ink which is to be supplied to the print head when the print head is attached to the body.

* * * * *